US006426169B1

(12) United States Patent
Onuma et al.

(10) Patent No.: US 6,426,169 B1
(45) Date of Patent: Jul. 30, 2002

(54) TONER CONTAINING AZO IRON COMPOUND

(75) Inventors: Tsutomu Onuma, Yokohama; Hirohide Tanikawa, Shizuoka-ken; Nobuyuki Okubo, Yokohama; Yoshihiro Ogawa, Shizuoka-ken; Tsuneo Nakanishi, Mishima; Katsuhisa Yamazaki, Numazu; Kaori Hiratsuka, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/698,256

(22) Filed: Oct. 30, 2000

(30) Foreign Application Priority Data

Oct. 29, 1999 (JP) ..... 11-310182

(51) Int. Cl.[7] ..... G03G 9/097

(52) U.S. Cl. ..... 430/108.23; 430/106.2; 430/111.4; 430/109.1

(58) Field of Search ..... 430/108.23, 111.4, 430/106.2, 109.1

(56) References Cited

U.S. PATENT DOCUMENTS

| | | | | |
|---|---|---|---|---|
| 2,297,691 A | | 10/1942 | Carlson | 95/5 |
| 3,666,363 A | | 5/1972 | Tanaka et al. | 355/17 |
| 4,071,361 A | | 1/1978 | Marushima | 96/1.4 |
| 5,489,498 A | | 2/1996 | Ohno et al. | 430/110 |
| 5,736,288 A | * | 4/1998 | Kasuya et al. | 430/108.23 |
| 5,744,276 A | | 4/1998 | Ohno et al. | 430/109 |
| 5,750,302 A | | 5/1998 | Ogawa et al. | 430/106.6 |
| 5,843,611 A | | 12/1998 | Sukata et al. | 430/110 |
| 5,972,553 A | * | 10/1999 | Katada et al. | 430/108.23 |
| 5,976,752 A | | 11/1999 | Matsunaga et al. | 430/110 |
| 6,030,737 A | * | 2/2000 | Ugai et al. | 430/108.23 |
| 6,060,202 A | | 5/2000 | Ogawa et al. | 430/111 |
| 6,090,515 A | | 7/2000 | Tomiyama | 430/106 |

FOREIGN PATENT DOCUMENTS

| | | |
|---|---|---|
| JP | 09-169919 | 6/1997 |
| JP | 11-7164 | 1/1999 |

* cited by examiner

*Primary Examiner*—Christopher Rodee
(74) *Attorney, Agent, or Firm*—Fitzpatrick, Cella, Harper & Scinto

(57) ABSTRACT

A toner having a stable chargeability in various environments, a stable fixability over a wide temperature range and a resistance to sticking on an image-bearing member, is formed of a binder resin, a colorant and an azo iron compound as a charge control agent. The azo iron compound is formed from a monoazo compound having at least one alkyl group and two hydroxyl groups capable of bonding with an iron atom. The toner has a tetrahydrofuran-soluble content providing a gel-permeation chromatogram showing at least one peak in a molecular weight region of $3\times10^3$ to $5\times10^4$ and at least one peak or shoulder in a molecular weight region of above $5\times10^4$ and at most $1\times10^7$.

20 Claims, 2 Drawing Sheets

TONER CONTAINING AZO IRON COMPOUND

FIELD OF THE INVENTION AND RELATED ART

The present invention relates to a toner used for developing electrostatic images in an image forming method, such as electrophotography or electrostatic recording, or for use in an image forming method according to the toner jetting scheme.

Hitherto, a large number of electrophotographic processes have been known, as disclosed in, e.g., U.S. Pat. Nos. 2,297,691, 3,666,363 and 4,071,361. In these processes, an electrostatic image is formed on a photosensitive member comprising generally a photoconductive material by various means, then the electrostatic image is developed with a toner, and the resultant toner image is, after being transferred onto a transfer(-receiving) material such as paper via or without via an intermediate transfer member, fixed by heating, pressing, heating and pressing, or with solvent vapor, to obtain a copy or a print. A transfer residual toner remaining on the photosensitive member after the transfer step is cleaned by various means, and the above-mentioned steps are repeated for a subsequent image forming cycle.

A toner has to be provided with a positive or a negative charge depending on the polarity of an electrostatic latent image to be developed therewith. A toner can be provided with a charge by utilizing the triboelectric chargeability of a resin as a toner component, but the chargeability obtained only by this measure is unstable, so that the toner image density cannot be raised quickly at an initial stage from start-up of image formation and the resultant images are liable to be foggy. Accordingly, in order to provide a toner with a desired triboelectric chargeability, it has been generally practiced to add a charge control agent to the toner.

Examples of negative chargeability-imparting charge control agents known at present may include: metal complex salts of monoazo dyes; metal complex salts of hydroxycarboxylic acids, dicarboxylic acids and aromatic diols; and resins containing acid components. On the other hand, examples of positive chargeability-imparting agents may include: nigrosine dyes, azine dyes, triphenylmethane dyes and pigments, quaternary ammonium salts, and polymers having a branch of quaternary ammonium salt.

However, many of metal complexes of azo dye structure used as charge control agents generally lack a stability and are liable to lose their initial charge control performance by decomposition or denaturation when subjected to mechanical friction or impact, change in temperature or humidity, electrical impact, or exposure to light. Further, some of them having a practical level of charge-imparting ability can be problematic in charge stability or contain much impurity chemicals lacking charge controlling effect due to fluctuation in production conditions, thus leaving problems in respects of stability and reliability of their performance.

For example, a monoazo dye metal complex disclosed in Japanese Laid-Open Patent Application (JP-A) 9-169919 is excellent in triboelectric charge-imparting performance but is still insufficient in providing stable developing performance regardless of environmental change, continual use and other conditions of use.

JP-A 11-7164 discloses an amorphous metal complex salt comprising a monoazo compound as a ligand for a charge control agent and also discloses alkyl group-containing monoazo compounds as examples. However, the JP reference does not disclose specific examples of producing a toner containing a metal complex salt including a ligand of such an alkyl group-containing monoazo compound as a charge control agent and does not pay consideration to a relationship between the charge control agent and a toner resin component. Further, such an amorphous metal complex is excellent in dispersibility in toner and charge-imparting performance but is liable to cause toner sticking onto the photosensitive member and gradual decrease in developing performance due to toner degradation in long-term use of the toner because it is relatively soft.

SUMMARY OF THE INVENTION

Accordingly, a generic object of the present invention is to provide a toner having solved the above-mentioned problems.

A more specific object of the present invention is to provide a toner capable of exhibiting excellent low-temperature fixability and anti-offset property even at a high process speed.

Another object of the present invention is to provide a toner capable of forming high-resolution and high-definition images.

Another object of the present invention is to provide a toner comprising toner particles wherein respective components are uniformly dispersed, and thus being capable of providing excellent images even in a long-term of use similarly as in the initial stage.

A further object of the present invention is to provide a toner excellent in long-term storability and environmental stability.

According to the present invention, there is provided a toner comprising toner particles each comprising a binder resin, a colorant and an organometallic compound, wherein the organometallic compound is an azo iron compound formed from a monoazo compound having at least one alkyl group and two hydroxyl groups capable of bonding with an iron atom, and the toner has a tetrahydrofuran-soluble content providing a gel-permeation chromatogram showing at least one peak in a molecular weight region of $3\times10^3$ to $5\times10^4$ and at least one peak or shoulder in a molecular weight region of above $5\times10^4$ and at most $1\times10^7$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
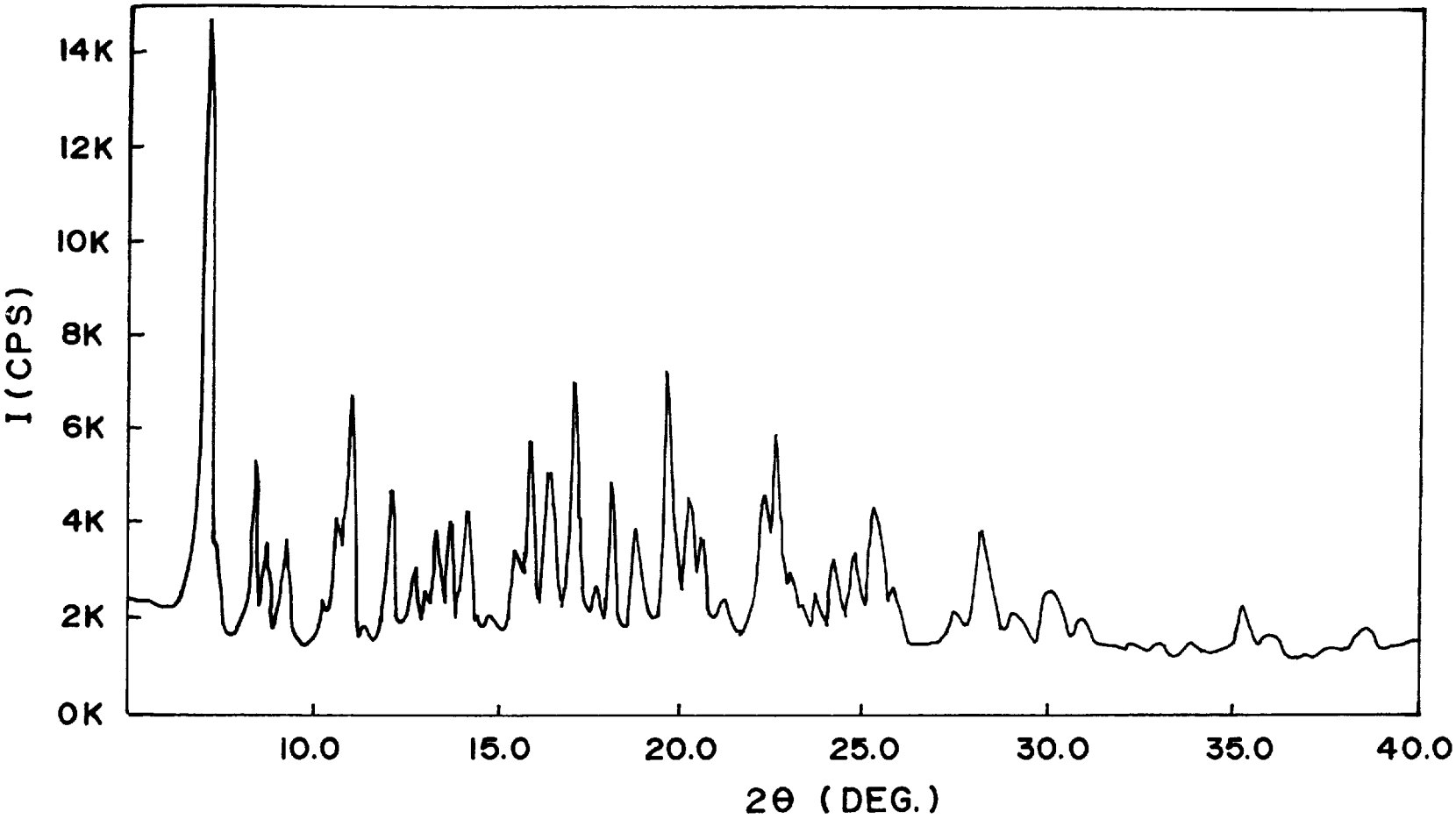
FIG. 1 shows an X-ray diffraction spectrum of Azo iron compound (1) used for production of a toner in Example 1.

As a result of our study, it has been found possible to provide a toner that shows a toner charge stability and a uniform chargeability at the time of toner blending over a long period and shows a good chargeability over a wide variety of environment inclusive of high temperature/high humidity environment and low temperature/low humidity environment, by incorporating an azo iron compound formed from a monoazo compound having at least one alkyl group and two hydroxyl groups capable of bonding with an iron atom as a charge control agent and provide the toner with a tetrahydrofuran (THF)-soluble content having such a molecular weight distribution as to provide a gel-permeation chromatogram (GPC chromatogram), obtained by GPC (gel-permeation chromatography), showing peaks and/or shoulders in specific molecular weight regions.

The azo iron compound used as a charge control agent in the present invention may for example include those represented by the following formulae (d), (e) and (f):

(d)

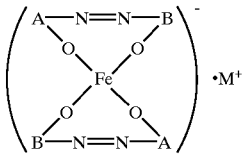

(e)

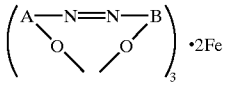

(f)

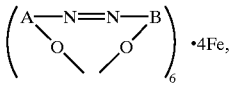

In each of the above formulae (d), (e) and (f), A and B independently denote o-phenylene group or 1,2-naphthylene group with the proviso that at least one of A and B has at least one alkyl group and A and B each can further have a halogen substituent; and M denotes a cation selected from hydrogen ion, alkali metal ions, ammonium ion and organic ammonium ions.

The azo iron compound used in the present invention shows good dispersibility in,the toner and can provide the toner with a good charge distribution, a stable initial charge increase characteristic and a good developing performance. Further, the toner of the present invention shows a good fixability over a wide temperature region because it contains a relatively low-molecular weight component and also a relatively high-molecular weight component as a molecular weight distribution measured by GPC. Further, as the azo iron compound has an alkyl group, it show a good affinity with a toner binder resin so that it can be sufficiently disposed in both the low-molecular weight component and the high-molecular weight component. As a result, it becomes possible to obviate a lowering in developing performance in a later stage of continuous image formation liable to be caused by poor dispersibility of a conventional monoazo compound, thus providing a toner with a good developing performance over a long period.

It is preferred that the azo iron compound is crystalline so as to suppress the lowering in developing performance in a long-term continuous image formation by using the toner. A crystalline azo iron compound is relatively hard, so that a degradation in long-term use can be obviated. Further, the hardness advantageously affects an increase in surface triboelectric chargeability and a higher developing performance of the toner. A conventional crystalline azo iron compound contained in a toner is liable to damage the photosensitive member because of the hardness and be liberated from the toner particles. However, as the azo iron compound of the present invention has an alkyl group, it shows a high dispersibility in the toner and shows suppressed liberation from the toner particles, and the increase in exposure of the azo iron compound to the toner particle surface during a continuous image formation is suppressed, so that the damage on the photosensitive member is suppressed. Further, because of the low-molecular weight component and the high-molecular weight component contained in combination in the toner, the toner can exhibit an appropriate level of viscosity to enhance the adhesion of the crystalline azo iron compound with other components of the toner, so that the dispersibility of the crystalline azo iron compound in the toner can be retained over a long period.

The crystallinity of an azo iron compound can be confirmed by analysis of an X-ray diffraction spectrum thereof. In other words, the crystallinity of an azo iron compound may be determined by the presence of remarkable diffraction peaks in an X-ray diffraction pattern thereof as shown in FIG. 1, which shows a plurality of diffraction: peaks in a range of 2θ=5 deg. to 30 deg. (θ=Bragg angle). It is preferred that the azo iron provides an X-ray diffraction spectrum showing at least one peak each in ia span of 5 deg. within a range of 2θ=5 deg. to 25 deg. For such an X-ray diffraction spectrum showing a plurality of diffraction peaks in a specified angle range, a crystallinity can be calculated. More specifically, it is preferred that the azo iron compound provides an X-ray diffraction pattern in a range of 2θ=5 deg. to 30 deg. (θ: Bragg angle) showing a crystallinity in terms of a ratio of a crystalline portion intensity total to an overall intensity total exceeding 50% as calculated by the multiple peak separation method, e.g., according to the following conditions. The effects accompanying the crystalline characteristic of the azo iron compound is enhanced at a higher crystallinity, and a crystallinity of 55% or higher, particularly 60% or higher, is further preferred.

A sample azo iron compound is subjected to measurement of an X-ray diffraction spectrum by an X-ray diffraction apparatus (e.g., "MXP$^3$ System", mfd. by K.K. Mac Science) using CuKa rays. The X-ray diffraction spectrum is smoothed in a Bragg angle 2θ range of 5–30 deg. to obtain a smoothed spectrum, which is separated into an overall spectrum and a crystalline portion spectrum. The separated respective spectra are subjected to crystallinity measurement to obtain an overall intensity total and a crystalline portion intensity total in the 2θ range of 5–30 deg., from which a crystallinity of the azo iron compound is calculated according to the following formula:

Crystallinity (%)=(crystallinity portion. intensity total)/(overall intensity total)×100.

It is preferred that the azo iron compound used in the present invention is produced from monoazo compounds represented by the following formula (a), (b) and (c) in view of start-up chargeability, and stable developing performances in terms of image density, fog and image quality.

(a)

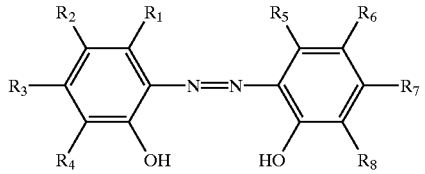

wherein $R_1$–$R_8$ independently denote a hydrogen atom, a halogen atom or an alkyl group with the proviso that at least one of $R_1$–$R_8$ is an alkyl group;

(b)

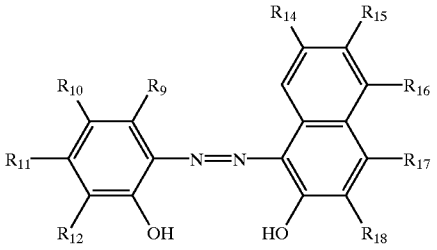

wherein $R_9$–$R_{18}$ independently denote a hydrogen atom, a halogen atom or an alkyl group with the proviso that at least one of $R_9$–$R_{18}$ is an alkyl group; and (c)

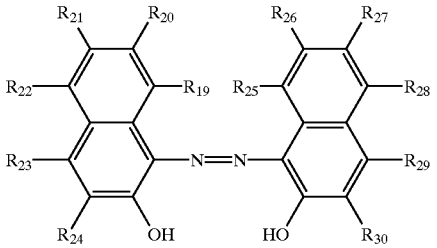

wherein $R_{19}$–$R_{30}$ independently denote a hydrogen atom, a halogen atom or an alkyl group with the proviso that at least one of $R_{19}$–$R_{30}$ is an alkyl group.

A monoazo compound having an alkyl group substituent as mentioned is preferred in order to provide a toner having a high chargeability and capable of forming images having a high image density and faithfully reproducing latent images.

As far as the monoazo compound has at least one alkyl group in its molecular structure, the position of the alkyl group substituent is not particularly restricted. In the case of the compound of the formula (b), however, it is preferred that an alkyl group is present at a position of at least one of groups $R_{13}$–$R_{18}$, particularly $R_{15}$, so as to provide the toner with a stable chargeability.

It is preferred that the monoazo compound has an alkyl group of 4–12 carbon atoms, particularly 6–10 carbon atoms, because of a good mutual solubility with the toner binder resin so as to provide a toner having a high and stable chargeability and capable of high-density images and high-definition images faithfully reproducing latent images. It is further preferred that the alkyl group has 4–12 carbon atoms including a tertiary carbon, more preferably 6–10 carbon atoms including a tertiary carbon. A most preferred alkyl group is represented by $—C(CH_3)_2—CH_2—C(CH_3)_3$.

It is further preferred that the monoazo compound has such a structure including a pair of units sandwiching the azo bond and including one unit containing a substituent of such an alkyl group and the other unit containing a substituent of a halogen atom, preferably a chlorine atom.

Among the monoazo compounds of the above formulae (a)–(c), the monoazo compound of the formula (b) is particularly preferred., Specific examples of the monoazo compound preferably used in the present invention may include Compounds 1 to 37 shown below:

(Compound 1)

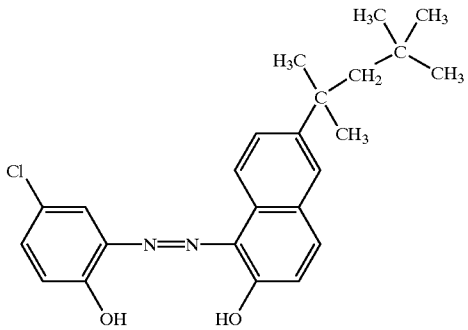

(Compound 2)

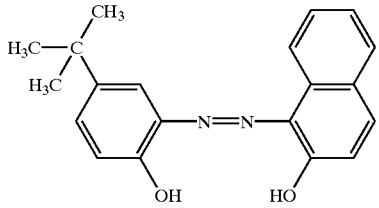

(Compound 3)

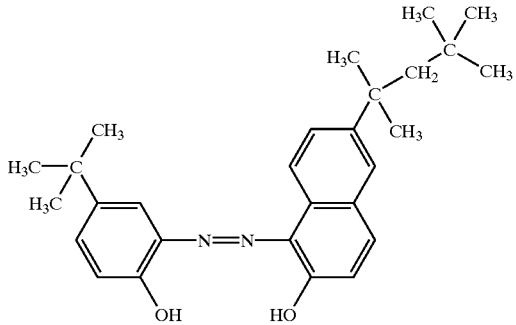

(Compound 4)

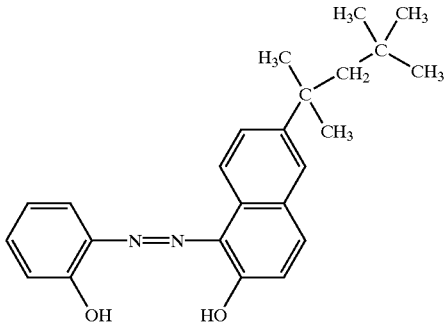

(Compound 5)

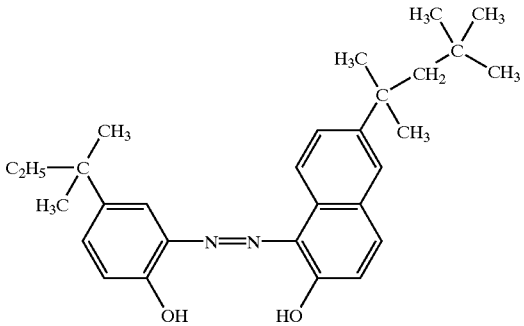

-continued
(Compound 6)
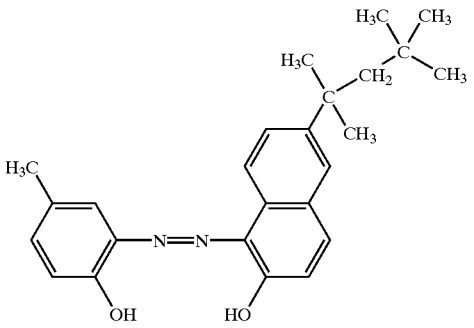
(Compound 7)
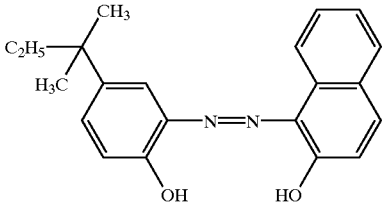
(Compound 8)
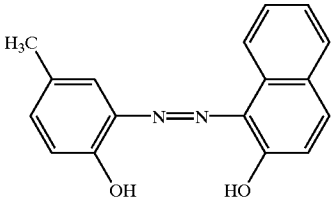
(Compound 9)
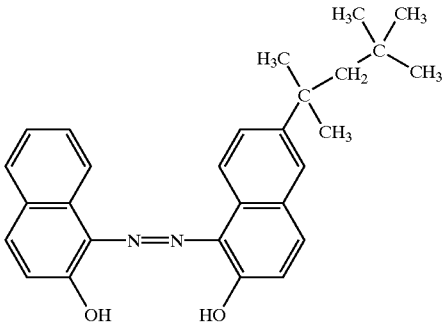
(Compound 10)
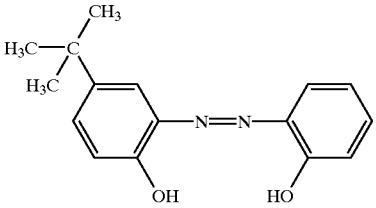
(Compound 11)
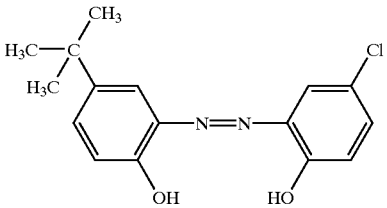
-continued
(Compound 12)
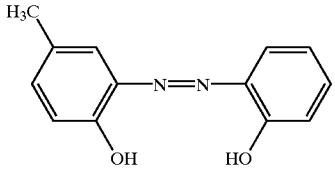
(Compound 13)
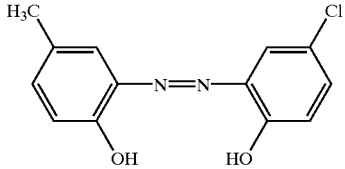
(Compound 14)
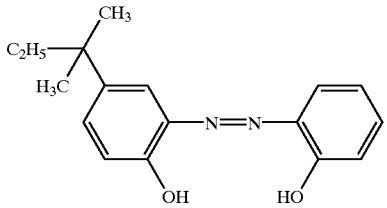
(Compound 15)
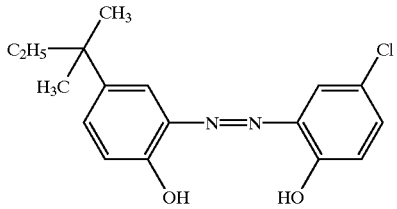
(Compound 16)
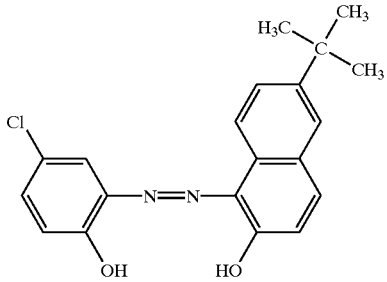
(Compound 17)
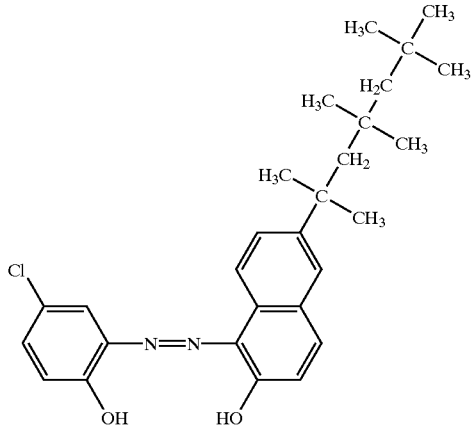

-continued
(Compound 18)
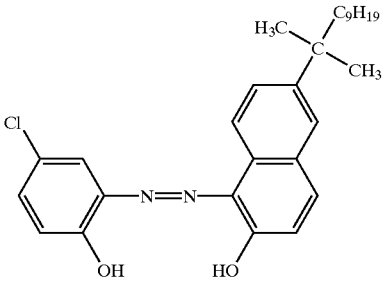
(Compound 19)
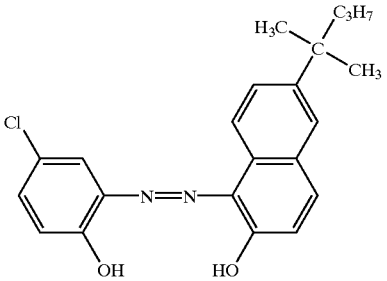
(Compound 20)
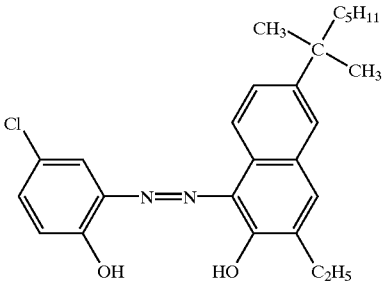
(Compound 21)
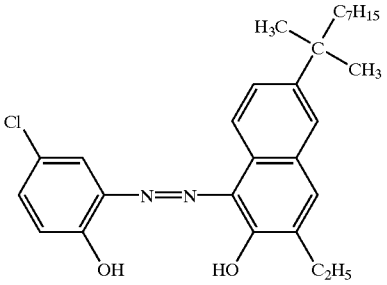
(Compound 22)
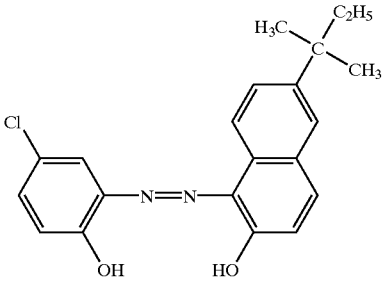
-continued
(Compound 23)
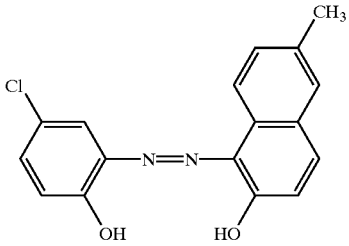
(Compound 24)
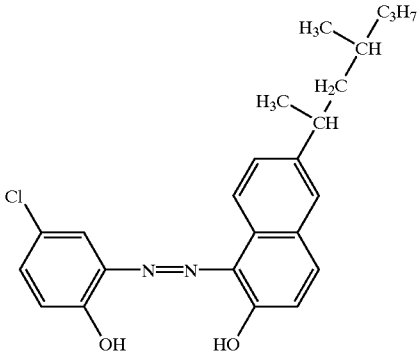
(Compound 25)
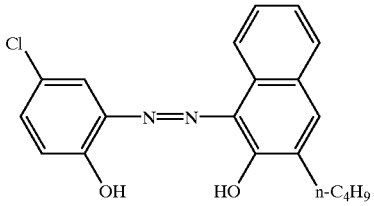
(Compound 26)
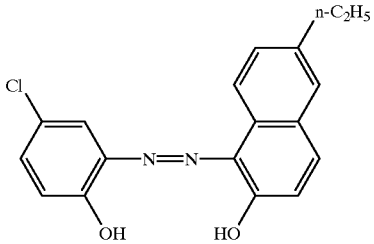
(Compound 27)
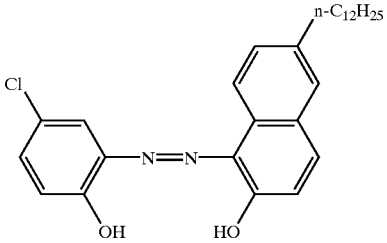
(Compound 28)
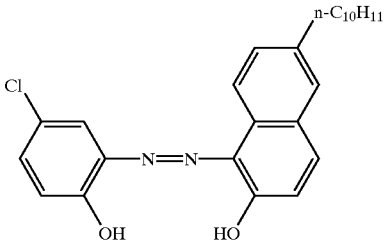

-continued
(Compound 29)
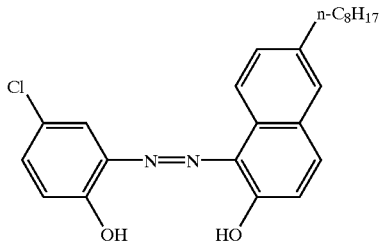
(Compound 30)
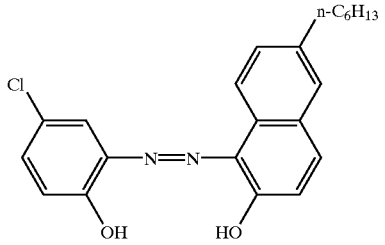
(Compound 31)
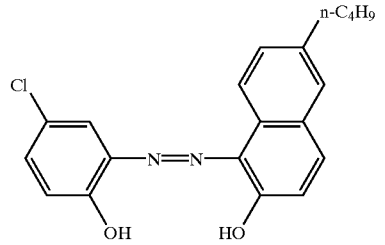
(Compound 32)
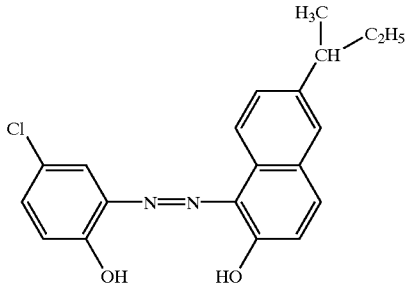
(Compound 33)
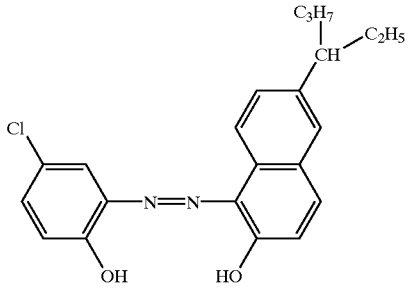
-continued
(Compound 34)
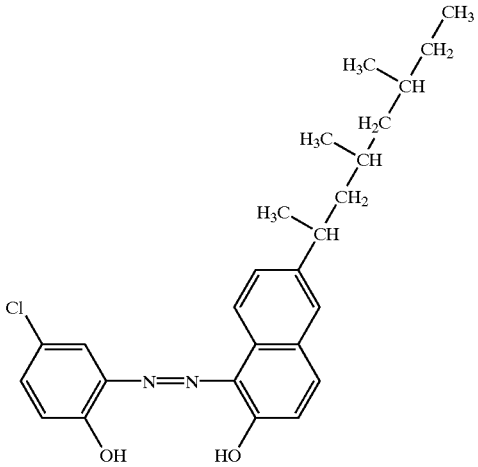
(Compound 35)
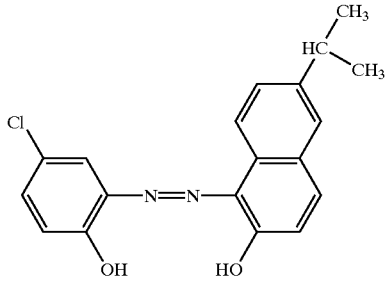
(Compound 36)
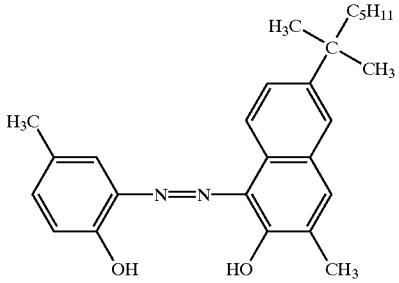
(Compound 37)
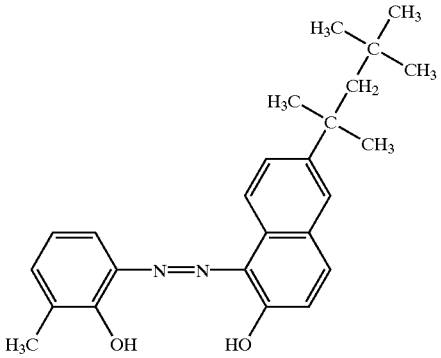

The azo iron compound may preferably be added to the toner in 0.1–10 wt. parts, more preferably in 0.5–5 wt. parts, per 100 wt. parts of the binder resin.

The azo iron compound can be used in combination with a charge control agent known to be used in a toner. Examples of such known charge control agents may include: other organometallic complexes, metal salts and chelate compounds; more specifically, acetylacetone metal complexes, hydroxycarboxylic acid metal complexes, polycarboxylic acid metal complexes, polyol metal complexes, and further carboxylic acid derivatives, such as metal salts, anhydrides and esters of carboxylic acids, condensates of aromatic compounds, and phenol derivative such as bisphenols and calixarenes.

The azo iron compound used in the present invention is a reaction product of iron and a monoazo compound and formed by coordination of a monoazo compound onto an iron atom. The azo iron compound may assume a form of an iron complex, an iron complex salt or a mixture of these, e.g., azo iron compounds of the above-mentioned formulae (d), (e) and (f), or a mixture of these.

In the present invention, owing to the reaction of the monoazo compound having an alkyl group with iron, the resultant azo iron compound becomes stabler thermally and with time than azo compounds of other metals and imparts a good and stable chargeability to the toner.

The azo iron compound may be obtained by reacting such a monoazo compound capable of bonding with an iron atom with an iron source compound in an aqueous and/or organic solvent, preferably in an organic solvent.

The reaction product formed in the organic solvent may be dispersed in an appropriate amount of water, and the precipitate is filtered out, washed with water and dried to obtain an azo iron compound. Example of the organic solvent as the reaction medium may include: water-miscible organic solvents, alcohols, ethers or glycols, such as methanol, ethanol, ethylene glycol monomethyl ether, ethylene glycol monoethyl ether, propylene glycol monomethyl ether, ethylene glycol dimethyl ether (monoglyme), diethylene glycol dimethyl ether (diglyme), ethylene glycol diethyl ether, triethylene glycol dimethyl ether (triglyme), tetraethylene glycol dimethyl ether (tetraglyme), ethylene glycol and propylene glycol; non-protonic polar solvents, such as N,N-dimethylformamide, N,N-dimethylacetamide, N-methyl-2-pyrrolidone, and dimethyl sulfoxide. Among the above organic solvents, ethylene glycol monomethyl ether (methyl cellosolve), ethylene glycol monoethyl ether (ethyl cellosolve) and ethylene glycol are particularly preferred in order to provide a crystalline azo iron compound. It is also preferred to re-crystalline a once-formed azo iron compound from an organic solvent as described above.

The amount of the organic solvent is not particularly restricted but may be used in an amount of 2 to 5 times the monoazo compound as the ligand by weight.

Suitable examples of the iron-source compound may include: ferric chloride, ferric sulfate and ferric nitride. The iron-source compound may be used in ⅓ to 2 equivalent, preferably ½ to ⅔ equivalent of Fe atom with respect to 1 mol of the monoazo compound as the liquid.

The toner contains a THF-soluble component having such a molecular weight distribution as to provide a GPC chromatogram showing at least one peak in a molecular weight region of $3\times10^3$ to $3\times10^4$, more preferably $3\times10^3$ to $2.5\times10^4$. Further, it shows at least one peak or shoulder in a molecular weight region of above $5\times10^4$ and at most $10^7$, preferably $10^5$ to $10^7$, more preferably $10^5$ to $5\times10^6$, further preferably $10^5$ to $1.5\times10^6$.

Herein, "a peak in a molecular weight region of $3\times10^3$ to $5\times10^4$" means that a peaktop is in the molecular weight region on the GPC chromatogram, and "a shoulder in a molecular weight region of above $5\times10^4$ and at most $10^7$" means that the GPC chromatogram shows an inflection point, i.e., a point giving a maximum of the differential of the curve, in the molecular weight region.

The toner showing the above-mentioned molecular weight distribution characteristic shows a good balance and storability, and also good uniform chargeability and continuous image forming performance.

As a result of the combination of the molecular weight distribution of the toner and the azo iron compound, advantageous effects as described below can be attained. That is, the azo iron compound used in the present invention has an alkyl group so that the compound can be uniformly dispersed in the toner and has a function of plascitizing the binder resin, particularly a low-molecular weight component thereof contributing to the fixability, thus improving the fixability. Further, as the high-molecular weight component of the binder resin can be simultaneously plasticized to some extent, the mutual solubility of the low-molecular weight compound and the high-molecular weight component is improved so that the high-molecular weight component is uniformly dispersed in the toner, whereby the toner can exhibit an enhanced release effect from the fixing member at the time of fixation.

Further, the toner according to the present invention contains the low-molecular weight component and the high-molecular weight component in a good balance, so that it has an appropriate degree of hardness and is rich in slippability. As a result, while the azo iron compound used in the present invention shows a high chargeability-imparting function and provides a toner which shows a high attachability and is liable to cause toner melt-sticking onto surrounding members, particularly the photosensitive member, the toner of the present invention is rich in slippability so the toner attachment onto the photosensitive member can be suppressed even in a high temperature/high humidity environment where the toner attachment is liable to occur.

If a component giving the peak or shoulder in the molecular weight region of above $5\times10^{14}$ and at most $10^7$ is not present in the THF-soluble content, the resultant toner is caused to have inferior anti-high-temperature offset characteristic. Further, the dispersibility of the azo iron compound therein and the slippability of the toner is liable to be insufficient to provide a toner showing an inferior developing performance and liable to cause toner sticking.

The molecular weight distribution of THF-soluble contents of toners or binder resins described herein are based on GPC measurement performed according to the following manner.

<Molecular Weight Distribution Measurement by GPC>

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number.

The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples, e.g., a combination of F-850, F-80, F-4, A-2500, F-450, F-40, F-2, A-1000, F-288, F-20, F-1, A-500, F-128, F-10, and A-5000, available from Toso K.K. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P.

The GPC sample may be prepared as follows.

A toner or binder resin sample is placed in THF and left standing for several hours. Then, the mixture is sufficiently shaken until a lump of the resinous sample disappears and then further left standing for more than 12 hours at room temperature. In this instance, a total time of from the mixing of the sample with THF to the completion of the standing in THF is taken for at least 24 hours. Thereafter, the mixture is caused to pass through a sample treating filter having a pore size of 0.2–0.5 $\mu$m (e.g., "Maishoridisk H-25-5", available from Toso K.K.) to recover the filtrate as a GPC sample. The sample concentration is adjusted to provide a resin concentration of e.g., 0.1 mg/ml.

Examples of the binder resin constituting the toner of the present invention may include: styrene resins, styrene copolymer resins, polyester resins, polyol resins, polyvinyl chloride resin, phenolic resin, natural resin-modified phenolic resin, natural resin-modified maleic acid resin, acrylic resin, methacrylic resin, polyvinyl acetate, silicone-resin, polyurethane resin, polyamide resin, furan resin, epoxy resin, epoxy resin, xylene resin, polyvinyl butyral, terpene resin, coumarone-indene resin, and petroleum resin.

Examples of comonomers for constituting the styrene copolymers as a preferred class of binder resin together with styrene monomer may include: styrene derivatives, such as vinyltoluene; acrylic acid; acrylate esters, such as methyl acrylate, ethyl acrylate, butyl acrylate, dodecyl acrylate, octyl acrylate, 2-ethylhexyl acrylate and phenyl acrylate; methacrylic acid; methacrylate esters, such as methyl methacrylate, ethyl methacrylate, butyl methacrylate, and octyl methacrylate; maleic acid; dicarboxylic acid esters having a double bond, such as butyl maleate, methyl maleate, and dimethyl maleate; acrylamide, acrylonitrile, methacrylonitrile, butadiene; vinylesters, such as vinyl chloride, vinyl acetate and vinyl benzoate; olefins, such as ethylene, propylene and butylene; and vinyl ketones, such as vinyl methyl ketone and vinyl hexyl ketone. These vinyl monomers may be used singly or in combination of two or more species.

The binder resin used in the present invention may preferably have an acid value of 1–100 mgKOH/g, more preferably 1–70 mgKOH/g, further preferably 1–50 mgKOH/g, particularly preferably 2–40 mgKOH/g. In case where the acid value of the binder resin is below the above-described range, it is possible that good developing performance and stable developing performance over a long period owing to the interaction between the binder resin and the azo iron compound are not sufficiently exhibited. On the other hand, in case where the binder resin has an excessively large acid value, the binder resin is liable to be hygroscopic, thus resulting in a lower image density and increased fog.

More specifically, by using a binder resin having an acid value, the chargeability-imparting performance of the azo iron compound is enhanced to realize a toner having a quick start-up chargeability and a high chargeability.

These effects sufficiently exhibited when the acid value measured based on the toner is 0.5–100 mgKOH/g, more preferably 0.5–50 mgKOH/g, particularly preferably 1.0–40 mgKOH/g..

The acid value of a toner or a binder resin described herein are based on values measured in the following manner.

<Acid Value Measurement>

The basic operation is according to JIS K-070.

1) A toner sample is preliminarily treated for removal of additives other than the binder resin (polymer component) or measurement of acid values and contents of components other than the binder resin. A toner or a binder resin is pulverized, and 0.5–2.0 g of the pulverized sample is accurately weighed to provide a sample containing W (g) of polymer component.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value is calculated according to the following equation:

$$\text{Acid value (mgKOH/g)}=\{(S-B)\times f\times 5.61\}/W,$$

wherein f denotes a factor of the 0.1 mol/liter-KOH solution.

Examples of monomers for adjusting the acid value of the binder resin may include: acrylic acids and α- and β-alkyl derivatives, such as acrylic acid, methacrylic acid, and α-ethylacrylic acid; other unsaturated monocarboxylic acids, such as crotonic acid, cinnamic acid, vinylacetic acid, isocrotonic acid, and angelic acid; and unsaturated dicarboxylic acids, such as fumaric acid, maleic acid, citraconic acid, alkenylsuccinic acid, itaconic acid, mesaconic acid, dimethylmaleic acid, and dimethylfumaric acid, and their monoester derivatives and anhydrides. These monomers may be used singly or in mixture of two or more species for copolymerization with another monomer to obtain a desired binder resin. Among these, monoester derivatives of unsaturated dicarboxylic acids are particularly preferred for the acid value control.

The monoester derivatives of unsaturated dicarboxylic acids may include: monoesters of α,β-unsaturated dicarboxylic acids, such as monomethyl maleate, monoethyl maleate, monoalkyl maleate, monophenyl maleate, monomethyl fumarate, monoethyl fumarate, monobutyl fumarate and monophenyl fumarate; and monoesters of alkenyldicarboxylic acids, such as monobutyl n-butenylsucciniate, monomethyl n-octenylsuccinate, monoethyl n-butenylmalonate, monomethyl n-dodecenylglutarate, and monobutyl n-butenyladipate.

Such a carboxyl group-containing monomer may be added in 0.1–50 wt. parts, preferably 0.1–30 wt. parts, further preferably 0.2–15 wt. parts per 100 wt. parts of the total monomers for constituting the binder resin.

The above-mentioned monoester of dicarboxylic acid is preferred because it is an ester which has a low solubility in aqueous dispersion medium and a high solubility in an organic solvent or another monomer.

The toner binder resin may preferably have a glass transition temperature (Tg) of 45–80° C., preferably 50–70° C., in view of the storability of the resultant toner. In case of a Tg below the above-mentioned range, the resultant toner is liable to be degraded in a high temperature environment and cause offsetting at the time of fixation. If the Tg is higher than the above range, the resultant toner is liable to exhibit an inferior fixability.

The binder resin for constituting the toner of the present invention may be produced through a polymerization process, such as solution polymerization, emulsion polymerization and suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The binder resin may preferably be produced in the presence of a polyfunctional polymerization initiator and/or a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethyl-cyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)triazine, 1,l-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl)-propane, and t-butylperoxyallylcarbonate.

These polyfunctional polymerization initiators may preferably be used in combination with a monofunctional polymerization initiator, more preferably with a monofunctional polymerization initiator having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, dicumyl peroxide, t-butylperoxycumene and di-t-butyl peroxide; and aza and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.01–10 wt. parts, particularly 0.05–2 wt. parts per 100 wt. parts of the monomer in view of the efficiency.

It is also preferred that the :binder resin has been crosslinked with a crosslinking monomer as enumerated hereinbelow.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallylcyanurate and triallyl trimellitate.

These crosslinking monomers may preferably be used in a proportion of 0.00001–1 wt. part, particularly about 0.001–0.05 wt. part, per 100 wt. parts of the other monomer components.

Among the above-mentioned crosslinking monomers, aromatic divinyl compounds (particularly, divinylbenzene)

and diacrylate compounds connected with a chain including an aromatic group and an ether bond may suitably be used in a toner resin in view of fixing characteristic and anti-offset characteristic.

Other polymerization processes, such as bulk polymerization and solution polymerization can also be utilized. The bulk polymerization allows production of arbitrary polymerization by adopting a high polymerization temperature providing an accelerated termination reaction speed, but the reaction cannot be controlled easily. In contrast thereto, according to the solution polymerization process, a low-molecular weight polymer can be produced under moderate conditions by utilizing the radical chain transfer function of the solvent and by adjusting the polymerization initiator amount or reaction temperature, so that the solution polymerization process is preferred for formation of a low-molecular weight component possibly contained in the binder resin. It is also effective to perform the solution polymerization under an elevated pressure, so as to suppress the amount of the polymerization initiator to the minimum and suppress the adverse effect of the residual polymerization initiator.

Examples of the monomer for providing the binder resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-polymers or styrene copolymers inclusive of styrene-acrylic type copolymers may be particularly preferred.

For providing the binder resin having the above-mentioned specific molecular weight distribution used in the present invention, it is possible to rely on various methods, inclusive of: a solution blending method wherein a high-molecular weight polymer and a low-molecular weight polymer are separately produced and are blended in a solution state, followed by removal of the solvent; a dry blending method of melt-kneading a high-molecular weight polymer and a low-molecular weight polymer in, e.g., an extruder; and a two-step polymerization method wherein a low-molecular weight polymer prepared by, e.g., solution polymerization is dissolved in a monomer for constituting a high-molecular weight polymer, and the resultant mixture is subjected to suspension polymerization, followed by washing and drying of the polymerizate to provide a resin composition. The two-step polymerization process is advantageous for realizing uniform dispersion, but is accompanied with a difficulty that an unnecessary low-molecular weight component is liable to be by-produced. The solution blending method is free from such a problem and allows the inclusion of the low-molecular weight component in a larger amount than the high-molecular weight component, so that it is most preferred. For the purpose of providing the low-molecular weight component with a prescribed acid value, it is preferred to rely on the solution polymerization which allows easier setting of the acid value than in the aqueous-system polymerization.

Further, in the case of using a polyester resin in the binder resin, the polyester resin may have a composition as described below.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

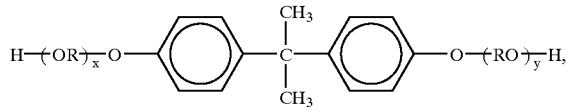

wherein R denotes an ethylene or propylene group, x and y are independently an integer of at least 0 with the proviso that the average of x+y is in the range of 0–10; diols represented by the following formula (B):

(B)

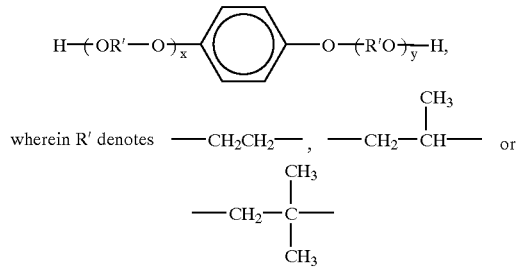

and x' and y' are independently an integer of at least 0 with the proviso that the average of x' +y' is in the range of 0–10.

Examples of the dibasic acid may include dicarboxylic acids and derivatives thereof inclusive of: aromatic dicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides and lower alkyl esters thereof; alkenyl- or alkyl-succinic acids, such as n-dodecenylsuccinic acid and n-dodecylsuccinic acid, and their anhydrides and lower alkyl esters thereof; and unsaturated dicarboxylic acids, such as fumaric acid, maleic acid, citraconic acid and itaconic acid, and their anhydrides and lower alkyl esters thereof.

It is preferred to also include a polyhydric alcohol component having at least three hydroxyl groups and/or a polycarboxylic acid component having at least three carboxyl groups.

Examples of the polyhydric alcohol having at least three hydroxyl groups may include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the polycarboxylic acid having at least three carboxyl groups may include polycarboxylic acids and derivatives thereof inclusive of: trimellitic acid, pyromellitic acid, 1,2,4-benzenetricarboxylic acid, 1,2,5-benzenetricarboxylic acid, 2,5,7-naphthalenetricarboxylic acid, 1,2,4 -naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empole trimer acid, and anhydrides and lower alkyl esters of these; and tetracarboxylic acids represented by the following formula, and anhydrides and lower alkyl esters thereof:

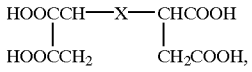

wherein X denotes an alkylene group or alkenylene group of 1–30 carbon atoms having at least one side chain of at least one carbon atom.

It is preferred that the alcohol component(s) may occupy 40–60 mol. %, preferably 45–55 wt. %, and the acid component(s) may occupy 60–40 mol. %, respectively, of the polyester forming monomers components. It is preferred that the polyhydric alcohol having at least three hydroxyl groups may occupy 1–60 mol. % of the total components. Similarly, it is preferred that the polycarboxylic acid having at least three carboxyl group may occupy 1–60 mol. % of the total components.

The polyester resin may be produced through an ordinary polycondensation process.

In the case of constituting the toner of the present invention as a magnetic mono-component toner, a magnetic material is incorporated in the toner. The magnetic material used for this purpose may for example comprise: an iron oxide such as magnetite, maghemite or ferrite; a metal, such as iron, cobalt or nickel, or an alloy of these metals with another metal, such as aluminum, cobalt, copper, lead, magnesium, tin, zinc, antimony, beryllium, bismuth, cadmium, calcium, manganese, selenium, titanium, tungsten or vanadium. It is preferred that the magnetic material contains a non-iron element at the surface or inside of the particles thereof.

More specifically, the magnetic material used in the present invention may preferably comprise a magnetic iron oxide, such as magnetite, maghemite or ferrite containing a different element or non-iron element. Such a magnetic iron oxide not only imparts the toner with good chargeability and magnetism but also functions as a colorant.

It is preferred that the magnetic iron oxide contains at least one element selected from lithium, beryllium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, luthenium, rhodium, and bismuth. More preferably, the non-iron element may be selected from lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. It is particularly preferred to use a magnetic iron oxide containing a non-iron element selected from the group consisting of magnesium, aluminum, silicon, phosphorus and sulfur. Such a non-iron element may be incorporated in the magnetic iron oxide crystal lattice, may be incorporated as an oxide thereof in the iron oxide, or may be present as an oxide or a hydroxide thereof at the surface of magnetic iron oxide particles. It is preferred that the non-iron element is incorporated as an oxide thereof.

Such a non-iron element may be incorporated in the magnetic iron oxide particles by causing a salt of the non-iron element to be co-present in an iron salt aqueous solution at the time of formation of the magnetic iron oxide and adjusting the pH of the system. Further, such a non-iron element may be precipitated at the surface of the magnetic iron oxide particles by subjecting a slurry containing magnetic iron oxide particles after the formation thereof to a pH adjustment or addition of a salt of such a non-iron element, followed by a pH adjustment.

A magnetic iron oxide containing such a non-iron element as described above shows a good affinity with the binder resin and a good dispersibility in the binder resin. Further, the good dispersibility of the magnetic iron oxide promotes the dispersion of the azo iron compound used in the present invention, thus allowing full exhibition of the effect of the azo iron compound. More specifically, the magnetic iron oxide particles function as a dispersion medium (a dispersion promoter) to aid the dispersion of the azo iron compound. Further, such a non-iron element-containing magnetic iron oxide is moisture-absorptive to some extent and has a function of promoting the chargeability of the azo iron compound due to the moisture.

Further, a uniform particle size distribution of the magnetic iron oxide particles advantageously affects the stabilization of toner chargeability in association with a good dispersibility thereof in the binder resin.

The non-iron element may preferably be contained in a proportion of 0.05–10 wt. %, more preferably 0.1–7 wt. %, further preferably 0.2–5 wt. %, more preferably 0.3–4 wt. %, based on the magnetic iron oxide. If the content is below the above-mentioned range, the addition effect thereof is scarce. In excess of the above range, the resultant magnetic iron oxide particles are liable to cause excessive charge liberation to result in an insufficient chargeability, thus causing a lower image density and increased fog.

It is preferred that such a non-iron modifier element is predominarily present in proximity to the surface of the magnetic particles. For example, when magnetic iron oxide particles are dissolved to a dissolution percentage of 20% of the ion content, it is preferred that 20 to 100% of the total non-iron element is dissolved, more preferably 25–100%, further preferably 30–100%. The predominant presence at the surface of the non-iron element promotes the dispersibility and electric diffusibility enhancing effects thereof onto the magnetic particles.

The magnetic particles may preferably have a number-average particle size of 0.05–1.0 $\mu$m, more preferably 0.1–0.5 $\mu$m, and a BET specific area of 2–40 $m^2/g$, more preferably 4–20 $m^2/g$. The magnetic particles may assume an arbitrary particle shape without particular restriction. The magnetic particles may preferably have magnetic properties including a saturation magnetization of 10–200 $Am^2/kg$, more preferably 70–100 $Am^2/kg$, as measured under a magnetic field of 795.8 kA/m, a residual magnetization of 1–100 $Am^2/kg$, more preferably 2– 20 $Am^2/kg$, and a coercive force of 1–30 kA/m, more preferably 2–15 kA/m. The magnetic material may preferably be used in 20–200 wt. parts, more preferably 40–150 wt. parts, per 100 wt. parts of the binder resin.

The contents of various elements may be measured by fluorescent X-ray analysis according to JIS K0119 (fluorescent X-ray analysis-general rules) by using a fluorescent X-ray analyzer (e.g., "SYSTEM 3080", available from Rigaku Denki Kogyo K.K.). The determination of distribution of respective elements may be performed by ICP (inductively coupled plasma) emission spectroscopy of gradually formed solutions at various degrees of dissolution in hydrochloric acid or hydrofluoric acid for determination of concentrations of respective elements in the solutions relative to the concentrations of the respective elements at full dissolution to determine the dissolution percentages of the respective elements for each gradually formed solution.

The number-average particle size of magnetic particles may be determined by taking enlarged photographs taken through a transmission electron microscope and processing images of particles on the enlarged photographs by a digitizer, etc., to determine a particle size distribution and a number-average particle size therefrom. Further, the magnetic properties described herein are based on values measured by applying an external magnetic field of 795.8 kA/m by using a vibrating sample-type magnetometer ("VSM-3S-15", available from Tosei Kogyo K.K.). The specific surface areas are based on values measured according to the BET multi-point method using nitrogen gas as adsorbent on a sample surface by using a specific surface area meter ("Autosorb 1", available from Yuasa Ionics K.K.).

In recent years, the use of smaller particle size toners has become popular. The toner of the present invention can exhibit a uniform chargeability and lower agglomeratability, thus providing images with an increased image density even at a small weight-average particle size (D4) of 2.5–10 $\mu$m. The effects are particularly noticeable at a weight-average particle size of 2.5–6.0 $\mu$m. D4 of at least 2.5 $\mu$m is preferred so as to provide a sufficient image density. On the other hand, at a smaller toner particle size, the liberation of the azo iron compound is liable to be promoted though the azo iron compound used in the present invention is relatively less liable to be liberated because of a good affinity with the binder resin. However, as the toner of the present invention has an excellent uniform chargeability, the performance thereof is less disadvantageously affected even some isolated azo iron compound is co-present. The above-mentioned preferred weight-average particle size (D4) ranges are applicable to both a magnetic toner and a non-magnetic toner.

The particle size distribution and weight-average particle size (D4) may be measured according to the Coulter counter method, e.g., by using Coulter Multisizer (=trade name, available from Coulter Electronics Inc.).

In the measurement, a 1%-NaCl aqueous solution may be prepared by using a reagent-grade sodium chloride as an electrolytic solution. It is also possible to use ISOTON R-II (available from Coulter Scientific Japan K.K.). Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 $\mu$m by using the above-mentioned apparatus with a 100 $\mu$m-aperture to obtain a volume-basis distribution and a number-basis distribution. The weight-average particle size ($D_4$) may be obtained from the volume-basis distribution by using a central value as a representative value for each channel.

The following 13 channels are used: 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m; 10.08–12.70 $\mu$m; 12.70–16.00 $\mu$m; 16.00–20.20 $\mu$m; 20.20–25.40 $\mu$m; 25.40–32.00 $\mu$m; and 32.00–40.30 $\mu$m. For each channel, a lower limit value is included, and an upper limit value is excluded.

The toner according to the present invention can contain a wax, examples of which may include; paraffin waxes and derivatives thereof; montan wax and derivatives thereof; microcrystalline wax and derivatives thereof; Fischer-Tropsche wax and derivatives thereof; polyolefin waxes and derivatives thereof; and carnauba wax and derivatives thereof. The derivatives may include: oxides, block copolymers and graft-modified products with vinyl monomers.

The toner according to the present invention may effectively contain one or more species of wax in a total amount of 0.1–15 wt. parts, preferably 0.5–12 wt. parts, per 100 wt. parts of the binder resin.

The toner according to the present invention contains a colorant. Examples thereof may include a magnetic iron oxide as mentioned above, and also appropriate pigments and dyes. Examples of the pigments may include: carbon black, aniline black, acetylene black, Naphthol Yellow, Hansa Yellow, Rhodamine Lake, Alizarin Lake, Phthalocyanine Blue, and Indanthrene Blue. These pigments may be used in an amount necessary and sufficient to provide a fixed image with a desired optical density, e.g., in 0.1–20 wt. parts, preferably 0.2–10 wt. parts per 100 wt. parts of the binder resin. For a similar purpose, a dye may be used, and examples thereof may include: azo dyes, anthraquinone dyes, xanthene dyes and methine dyes. The dye may be added in 0.1–20 wt. parts, preferably 0.3–10 wt. parts per 100 wt. parts of the binder resin.

The toner according to the present invention may preferably contain fine powder of inorganic materials inclusive of inorganic oxides, such as silica, alumina and titanium oxide, and carbon black and fluorinated carbon externally added to the toner particles.

Such inorganic fine powder may preferably be dispersed in fine particles on the surface of toner particles so as to exhibit a high flowability improvement effect. Accordingly, the inorganic fine powder may preferably have a number-average particle size of 5–200 nm, more preferably 10–100 nm, and a specific surface area as measured by the BET method according to nitrogen adsorption of at: least 30 $m^2/g$, more preferably 60–400 $m^2/g$, in a state before surface treatment and at least 20 $m^2/g$, more preferably 40–300 $m^2/g$, in a state after surface treatment.

Such fine powder may preferably be added in 0.03–5 wt. parts per 100 wt. parts of the toner particles so as to provide an adequate surface coverage rate.

The inorganic fine powder may preferably exhibit a hydrophobicity in terms of a methanol wettability of at least 30%, more preferably 50% or higher, e.g., by surface treatment with a hydrophobization agent, preferred examples of which may include silicon-containing surface-treating agents of silane compounds and silicone oil.

Specific examples of the silane compounds may include: alkylalkoxysilanes, such as dimethyldimethoxysilane, trimethylethoxysilane and butyltrimethoxysilane; and further dimethyldichlorosilane, trimethylchlorosilane, allyldimethylchlorosilane, hexamethyldisilazane, allylphenyldichlorosilane, benzydimethylchlorosilane, vinyltriethoxysilane, γ-methacryloxypropyltrimethoxysilane, vinyltriacetoxysilane, divinylchlorosilane and dimethylvinylchlorosilane.

The toner according to the present invention can also be blended with a carrier to form a two-component developer. The carrier may preferably exhibit a resistivity of $10^6$–$10^{10}$ ohm.cm by adjusting a surface roughness and an amount of a surface-coating resin.

Examples of the carrier surface-coating resin may include: styrene-acrylate ester copolymer, styrene-methacrylate ester copolymer, acrylate ester copolymer, methacrylate ester copolymer, silicone resin, fluorine-containing resin, polyamide resin, ionomer resin, polyphenylene sulfide, and mixtures of these.

The carrier core may comprise a magnetic material, examples of which may include: oxides, such as ferrite, iron excess-type ferrite, magnetite and γ-iron oxide; metals, such as iron, cobalt and nickel, and alloys of these. These magnetic materials may further contain an additional element, such as iron, cobalt, nickel, aluminum, copper, lead, magnesium, tin, zinc, antimony, beryllium, bismuth, calcium, manganese, selenium, titanium, tungsten, or vanadium.

Further, in order to provide the toner with improved developing performance and continuous image forming performance, it is also preferred to externally add powders of inorganic materials as follows. Namely, oxides of metals, such as magnesium, zinc, aluminum, cerium, cobalt, iron, zirconium, chromium, manganese, strontium, tin and antimony; composite metal oxides, such as calcium titanate, magnesium titanate, and strontium titanate; metal salts, such as calcium carbonate, magnesium carbonate, magnesium carbonate, and aluminum carbonate; clay minerals, such as kaolin, phosphate compounds, such as apatite; silicon compounds, such as silicon carbide, and silicon nitride; and carbons, such as carbon black and graphite.

It is also possible to add powder of a lubricant to the toner. Examples of the lubricant may include: fluorine-containing resins, such as polytetrafluoroethylene and polyvinylidene fluoride, and fluorine-containing compounds, such as fluorinated carbon.

The toner according to the present invention may preferably be produced through a pulverization process wherein the toner ingredients as mentioned above are sufficiently blended in a blender, such as a ball mill, melt-kneaded by hot kneading means, such as a hot roller kneader and an extruder, solidified by cooling, mechanically pulverized by a pulverizer and classified by a classifier to obtain toner particles. However, it also possible to rely on a polymerization toner production process wherein a monomer for constituting a binder resin is mixed with other toner ingredients to form a polymerizable composition, and the composition is subjected to polymerization in an aqueous medium, preferably suspension polymerization; a process for producing a microcapsule toner comprising a core and a shell, at least one of which contains prescribed toner components; and a process for dispersing in a binder resin solution other toner ingredients and spray-drying the resultant mixture. The thus-obtained toner particles may be blended with desired external additives by a blender, such as a Henschel mixer to obtain a toner according to the present invention.

Various machines are commercially available for the above process. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukwa Shoji K.K.). As the sieving apparatus, Ultrasonic (Koei Sangyo K.K.), Rezona Sieve and Gyrosifter (Tokuju Kosaku K.K.), Ultrasonic System (Dolton K.K.), Sonicreen (Shinto Kogyo .K.K.), Turboscreener (Turbo Kogyo K.K.), Microshifter (Makino Sangyo K.K.), and circular vibrating sieves.

Hereinafter, the present invention will be described more specifically based on Examples, which however should not be understood to restrict the scope of the present invention in any way. In the following Examples, "part(s)" means "part(s) by weight".

Production Example 1 for Azo Iron Compound

A monoazo compound synthesized by an ordinary coupling reaction between 4-chloro-2-aminophenol and 6-t-octyl-2-naphthol was added to N,N-dimethylformamide under stirring. Into the solution, sodium carbonate was added and the mixture was heated to 70° C., followed by addition of Fe(II )$SO_4$.7$H_2O$ and 5 hours of reaction. The system was cooled to room temperature by standing, and a precipitated product was filtered out and added into isopropanol, followed by dissolution by re-heating to 70° C. and cooling by standing to precipitate an azo iron compound. The compound was filtered out, washed with water and dried to obtain Azo iron compound (1) represented by the following formula. Azo iron compound (1) provided an X-ray diffraction spectrum as shown in FIG. 1 and exhibited a crystallinity of 68.0%.

(1)

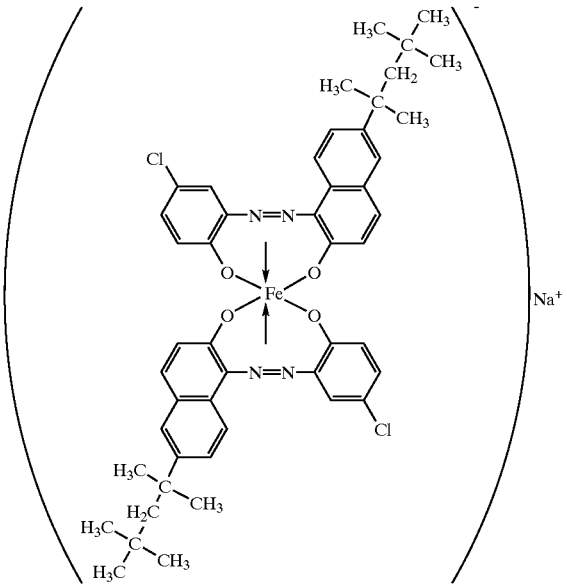

Production Example 2 for Azo Iron Compound

Azo iron compound (2) represented by a formula shown below was prepared in the same manner as in Production Example 1 except for using 4-t-pentyl-2-aminophenol in place of 4-chloro-2-aminophenol for synthesis of a monoazo compound. Azo iron compound (2) exhibited a crystallinity of 67.2%.

(2)

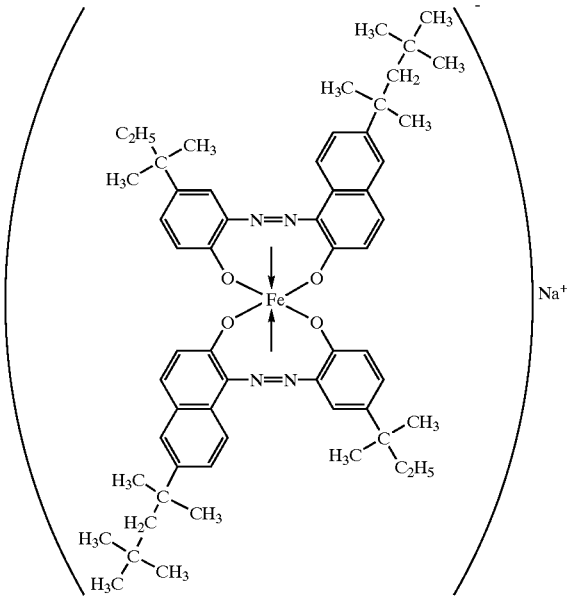

Production Example 3 for Azo Iron Compound

Azo iron compound (3) represented by a formula shown below was prepared in the same manner as in Production Example 1 except for using 2-aminophenol in place of 4-chloro-2-aminophenol for synthesis of a monoazo compound. Azo iron compound (3) exhibited a crystallinity of 66.8%.

(3)

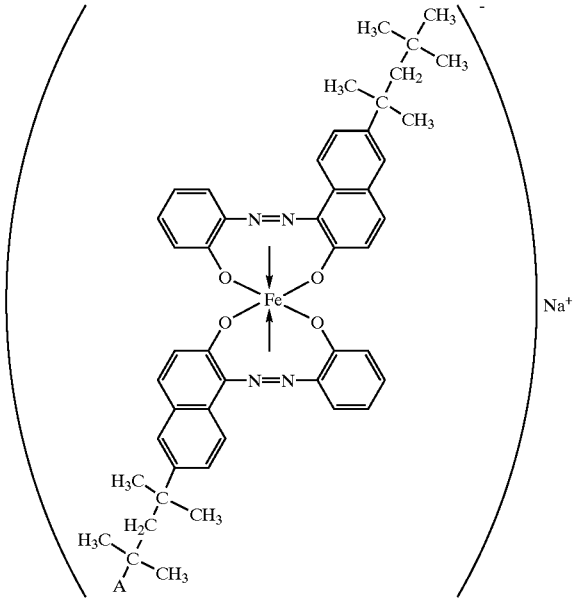

Production Example 4 for Azo Iron Compound

Azo iron compound (4) represented by a formula shown below was prepared in the same manner as in Production Example 1 except for using 6-t-butyl-2-naphthol in place of 6-t-octyl-2-naphthol for synthesis of a monoazo compound. Azo iron compound (4) exhibited a crystallinity of 65.8%.

(4)

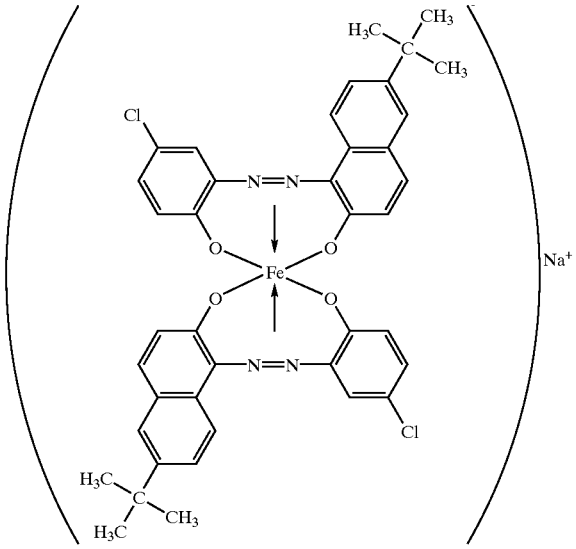

Production Example 5 for Azo Iron Compound

Azo iron compound (5) represented by a formula shown below was prepared in the same manner as in Production Example 1 except for using 6-methyl-2-naphthol in place of 6-t-octyl-2-naphthol for synthesis of a monoazo compound. Azo iron compound (5) exhibited a crystallinity of 63.0%.

(5)

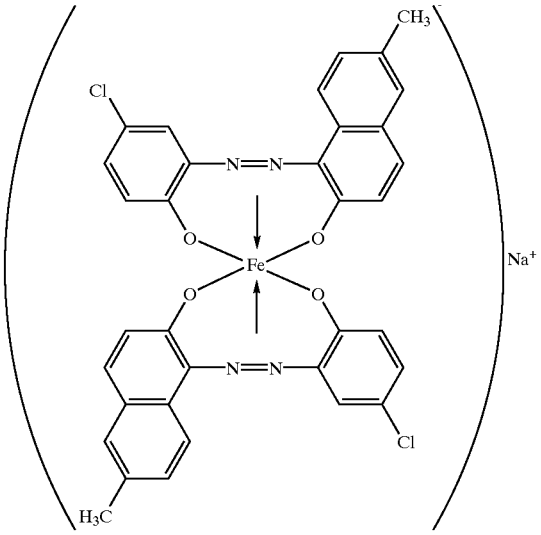

Production Example 6 for Azo Iron Compound

Azo iron compound (6) represented by a formula shown below was prepared in the same manner as in Production Example 1 except for using 3-n-butyl-2-naphthol in place of 6-t-octyl-2-naphthol for synthesis of a monoazo compound. Azo iron compound (6) exhibited a crystallinity of 64.8%.

(6)

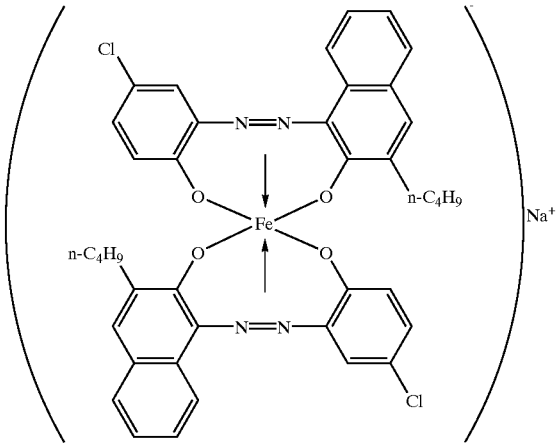

Production Example 7 for Azo Iron Compound

Azo iron compound (7) represented by a formula shown below was prepared in the same manner as in Production Example 1 except for using 2-naphthol and 4-methyl-2-aminophenol for synthesis of a monoazo compound. Azo iron compound (7) exhibited a crystallinity of 62.2%.

(7)

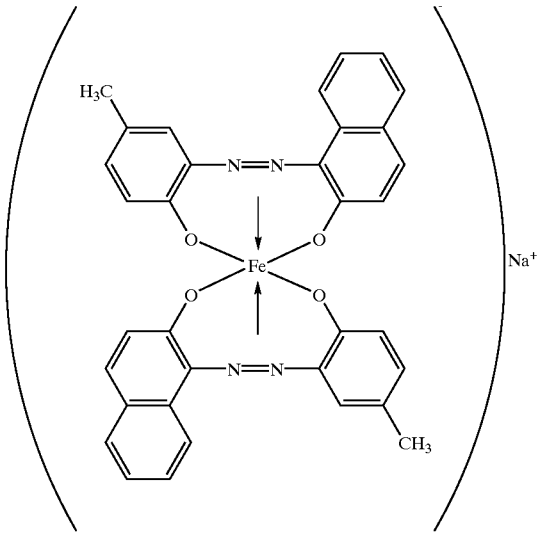

Production Example for Azo Chromium Compound

Azo chromium compound (8) represented by a formula shown below was prepared in a similar manner as in Production Example 1 except for using 2-naphthol and 4-t-pentyl-2-aminophenol for synthesis of a monoazo compound, and using chromium (III) formate in place of $Fe(II)SO_4.7H_2O$. Azo chromium compound (8) exhibited a crystallinity of 60.7%.

(8)

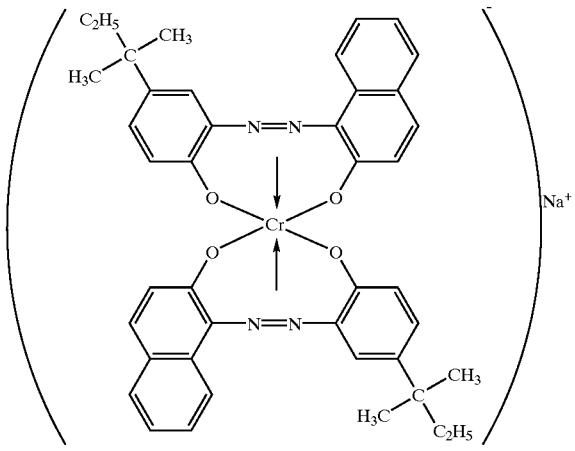

Production Example 9 for Azo Iron Compound

Azo iron compound (9) represented by a formula shown below was prepared in the same manner as in Production Example 1 except for using 2-naphthol in place of 6-t-octyl-2-naphthol for synthesis of a monoazo compound. Azo iron compound (9) exhibited a crystallinity of 59.6%.

(9)

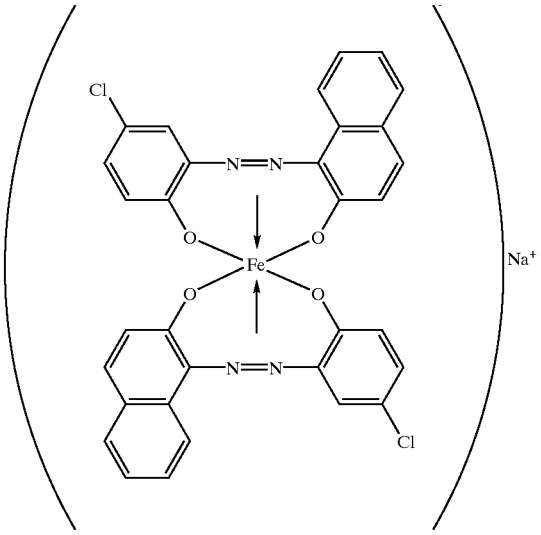

Production Example 10 for Azo Iron Compound

The procedure of Production Example 7 was repeated up to the addition and reaction of Fe(II)SO4.7$H_2O$. Thereafter, the system was cooled by standing to room temperature, and the reaction liquid was not subjected to the precipitation or crystallization in isopropanol but was dispersed in N,N-dimethylformamide (DMF), followed by recovery by filtration, washing with water and drying to obtain Azo iron compound (10) in an amorphous state. Azo iron compound (10) exhibited a crystallinity of 13.8%.

Some binder resins were prepared generally through two steps as shown in the following production examples.

Polymer Production Example 1

300 parts of xylene was placed in a four-necked flask, and the interior of the flask was sufficiently aerated with nitrogen under stirring. Then, the xylene was heated and subjected to refluxing. Under the reflux condition, a liquid mixture of 68.8 parts of styrene, 22 parts of n-butyl acrylate, 9.2 parts of monobutyl maleate and 1.8 parts of di-tert-butyl peroxide was added dropwise in 4 hours and held for 2 hours for completing the polymerization, followed by removal of the solvent to obtain Polymer (L1) of a low-molecular weight. Polymer (L1) provided a GPC chromatogram showing a peak molecular weight (Mp) of 15000 and an acid value of 30.0 mgKOH/g. The polymerization composition, peak molecular weight (Mp) and acid value of Polymer (L1) are shown in Table 1 together with those of polymers obtained in the following Polymer Production Examples.

Polymer Production Examples 2–6

Polymers (L2)–(L6) of low molecular weight were prepared in the same manner as in Polymer Production Example 1 except for changing polymerization compositions (respective monomer amounts and initiator amounts and addition of divinylbenzene as desired) as shown in Table 1.

Polymer Production Example 7

Into a four-necked flask, 180 parts of deaerated water and 20 parts of 2 wt. %-polyvinyl alcohol aqueous solution were placed, and a liquid mixture of 78.4 parts of styrene, 20 parts of n-butyl acrylate, 1.6 parts of monobutyl maleate and 0.18 part of 2,2-bis(4,4-di-tert-butylperoxycyclohexyl)propane, was added thereto, followed by stirring to form a suspension liquid. After the interior of the flask was sufficiently aerated with nitrogen, the system was heated to 90° C. to initiate the polymerization. The system was held at that temperature for 24 hours to complete the polymerization. The polymerizate was filtered out, washed with water and dried to obtain Polymer (H1) of high molecular weight. Polymer (H1) provided a GPC chromatogram showing Mp=$8\times10^5$ and exhibited an acid value of 5.1 mgKOH/g.

Polymer Production Examples 8–10

Polymers (H2)–(H4) of high molecular weight were prepared in the same manner as in Polymer Production Example 7 except for changing polymerization compositions (respective monomer amounts and initiator amounts and addition of divinylbenzene as desired) as shown in Table 1.

Polymer Production Example 11

Polymer (H5) of high molecular weight was prepared in the same manner as in Polymer Production Example 1 except for changing polymerization compositions (respective monomer amounts and initiator amounts add addition of divinylbenzene as desired) as shown in Table 1.

TABLE 1

| | Polymers | | | | | | | |
|---|---|---|---|---|---|---|---|---|
| | Polymerization composition* (wt. parts) | | | | | | | |
| | Monomers | | | Initiators and DVB | | | | Acid value |
| Polymer | MBM | Sty | nBA | DTBP | DVB | BBCP | Mp ($\times10^3$) | (mgKOH/g) |
| L1 | 9.2 | 68.8 | 22 | 1.8 | — | — | 15 | 30.0 |
| L2 | 0.1 | 79.9 | 20 | 2.2 | — | — | 10 | 0.3 |
| L3 | 8.8 | 70.2 | 21 | 1.5 | — | — | 22 | 28.3 |
| L4 | 1.4 | 78.6 | 20 | 2.5 | — | — | 7 | 4.4 |
| L5 | 28.4 | 49.6 | 22 | 1.9 | — | — | 14 | 93.1 |
| L6 | 7.8 | 71.2 | 21 | 0.5 | 0.1 | — | 70 | 25.2 |
| H1 | 1.0 | 78.4 | 20 | — | — | 0.18 | 800 | 5.1 |
| H2 | 2.4 | 77.6 | 20 | — | — | 0.22 | 550 | 7.8 |
| H3 | 2.0 | 78.0 | 20 | — | 0.01 | 0.16 | 1080 | 7.1 |

TABLE 1-continued

| Polymers | | | | | | | | |
|---|---|---|---|---|---|---|---|---|
| | Polymerization composition* (wt. parts) | | | | | | | |
| | Monomers | | | Initiators and DVB | | | | Acid value |
| Polymer | MBM | Sty | nBA | DTBP | DVB | BBCP | Mp ($\times 10^3$) | (mgKOH/g) |
| H4 | — | 80.0 | 20 | — | — | 0.20 | 780 | 0.1 |
| H5 | 0.9 | 79.1 | 20 | 0.5 | 0.15 | — | 150 | 3.0 |

*MBM = monobutyl maleate, Sty = styrene, nBA = n-butyl acrylate, DTBP = di-t-butyl peroxide, DVB = divinylbenzene, BBCP = 2,2-bis(4,4-di-t-butylperoxycyclohexyl)propane.

Binder Production Example 1

Polymer (L1) and Polymer (H1) were blended in solvent xylene and the solvent was removed to obtain Binder resin 1.

Binder Production Examples 2–7

Binder resins 2–7 were prepared in the same manner as in Binder Production Example 1 except for changing the species of Polymers to be blended as shown in Table 2.

The glass transition temperature (Tg) and acid values of the thus-prepared binder resins are also shown in Table 2.

TABLE 2

| Binder resin | | | | |
|---|---|---|---|---|
| Binder resin | Polymers (7:3) | | Tg (° C.) | Acid-value (mgKOH/g) |
| 1 | L1 | H1 | 60.2 | 23.2 |
| 2 | L2 | H2 | 62.3 | 2.5 |
| 3 | L3 | H3 | 61.2 | 21.0 |
| 4 | L4 | H2 | 60.8 | 5.4 |
| 5 | L5 | H2 | 58.9 | 71.5 |
| 6 | L2 | H4 | 62.7 | 0.2 |
| 7 | L1 | H5 | 59.5 | 21.8 |

Production of Magnetic Materials

Magnetic materials (magnetic iron oxides) a, b and c shown in Table 3 below were prepared by varying the species and amount of non-Fe elements (added in the form of salts) and by changing pH adjustment conditions during production of magnetic iron oxide. The non-Fe element contents shown in Table 3 are expressed in wt. % based on the magnetic iron oxide. The magnetic properties (σs=saturation magnetization, σr=residual magnetization, Hc=coercive force) and the dissolution rate (%) of the non-Fe element at 20% dissolution of Fe, and the number-average particle size (Dn) of the magnetic materials, are also shown in Table 3.

TABLE 3

| Magnetic materials | | | | | | | |
|---|---|---|---|---|---|---|---|
| Magnetic material | Non-Fe element (wt. %) | Dn ($\mu$m) | Dissolution (%) at 20% Fe dissolution Si | Dissolution (%) at 20% Fe dissolution Al | σs ($Am^2/kg$) | σr ($Am^2/kg$) | Hc (kA/m) |
| a | Si = 0.5<br>Al = 0.2 | 0.22 | 71.3 | 99.5 | 85.1 | 5.3 | 5.2 |
| b | Si = 0.5 | 0.20 | 60.4 | — | 82.3 | 4.0 | 3.7 |
| c | — | 0.21 | — | — | 84.6 | 4.7 | 4.7 |

(Preparation and Evaluation of Toners)

EXAMPLE 1

| | |
|---|---|
| Binder resin 1 | 100 parts |
| Magnetic material a | 95 parts |
| Polypropylene wax | 4 parts |
| Azo iron compound (1) | 2 parts |

The above ingredients were melt-kneaded by means of a twin-screw extruder heated at 130° C. After cooling, the kneaded product was coarsely crushed by a hammer mill and then finely pulverized by a jet mill. The pulverizate was classified by a fixed wall-type pneumatic classifier to obtain classified powder, which was further subjected to strict classification by means of a multi-division classifier ("Elbow Jet", made by Nittetsu Kogyo K.K.) utilizing the Coanda effect for removal of fine powder fraction and coarse powder fraction to obtain Toner 1 of negative chargeability having a weight-average particle size (D4) of 6.8 $\mu$m. Physical properties of Toner 1 thus obtained are shown in Table 4 together with those of toners prepared in other Examples and Comparative Examples described hereinafter.

Toner 1 in 100 wt. parts was blended with 1.2 wt. parts of hydrophobic silica fine powder by means of a Henschel mixer to obtain a developer (a monocomponent magnetic toner). The developer was evaluated in the following manner and the evaluation results are shown in Table 5 together with those of the other Examples and Comparative Examples.

(Image Forming Test)

A commercially available laser beam printer ("LBP-930", made by Canon K.K.) was remodeled so as to increase the paper feed rate of 24 A4-size lateral sheets/min. to a paper feed rate of 40 A4-size lateral sheets/min. by increasing the process speed to 200 mm/sec. and provide fixing conditions of a total pressure of 30 kg and a nip of 8 mm between the heating roller and the pressure roller in the fixing device. The above-prepared Toner 1 was charged in a process cartridge for the above-remodeled laser beam printer. The outline of the process cartridge is illustrated in FIG. 2.

Figure 2:
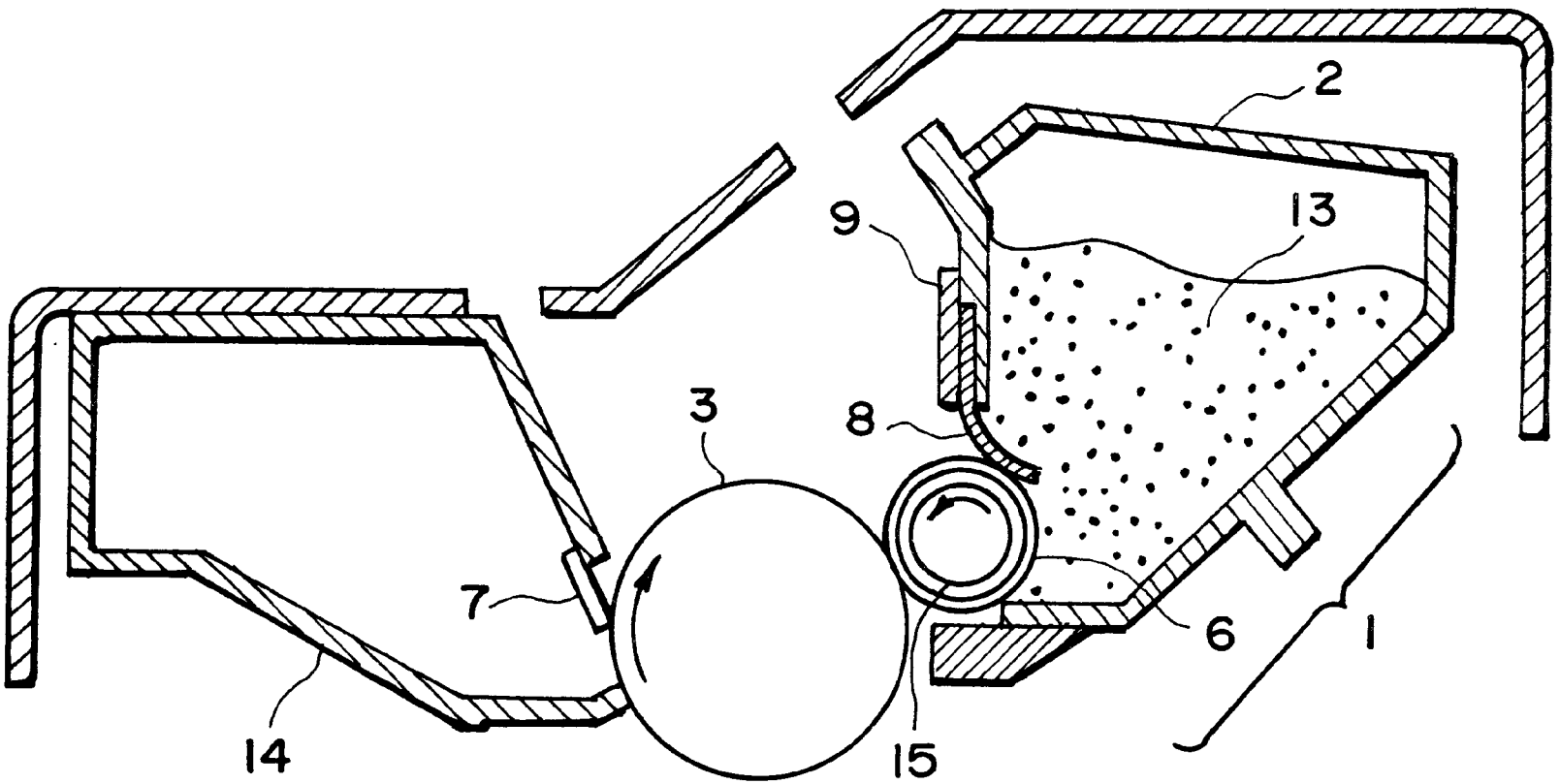
FIG. 2 illustrates an organization of a cartridge for a laser beam printer used for evaluating the toner performances in Examples and Comparative Examples.

Referring to FIG. 2, a developing device 1 includes a developer vessel 2 for storing a developer (toner) 13, a developing sleeve 6 for carrying the developer 13 in the developer vessel 2 from the developer vessel 2 to a developing region where the developing sleeve 6 becomes opposite to an electrostatic latent image-bearing member (photosensitive drum) 3, an elastic blade 8 for regulating the developer carried on the developing sleeve 6 into a thin layer of a prescribed thickness on the developing sleeve, and a magnet 15 enclosed within the developing sleeve 6. The elastic blade 8 is supported by a support member 9 and abutted against the developing sleeve 6 surface. The cartridge also includes the photosensitive drum 3, and a cleaning device 14 including a cleaning blade 7 abutted against the photosensitive drum 3 for removal of transfer residual toner from the photosensitive drum.

By using the above-remodeled laser beam printer, Toner 1 (as a sample toner) was subjected to image forming tests in normal temperature/normal humidity environment (23° C./60%RH), a high temperature/high humidity environment (32.5° C./80%RH) and a low temperature/low humidity environment (15° C./10%RH). The image formation was performed in an intermittent mode of placing a pause period of 20 sec after every printing on two sheets. The images thus formed were evaluated with respect to the following items.

(1) Image Density (I.D.)

Images were continuously printed on 15000 sheets of plain paper (75 g/m$^2$) for copying, and image densities were measured at the initial stage and the final stage of the continuous printing operation in terms of a relative density compared with that of a white background portion corresponding to an original image density of 0.00 by using a Macbeth densitometer (available from Macbeth Co.).

(2) Fog

Images were continuously printed on 15000 sheets of plain paper (75 g/m$^2$) for copying in the low temperature/low humidity environment, and fog was evaluated at the initial stage and the final stage of the continuous printing operation by measuring a whiteness of the plain paper before printing and a whiteness of a printed solid white image portion on the plain paper respectively by using a reflectometer (available from Tokyo Denshoku K.K.). The difference in whiteness represents a fog. A smaller fog value represents less fog.

(3) Toner Sticking

Images were continuously printed on 15000 sheets of plain paper in the high temperature/high humidity environment. The photosensitive drum surface after the continuous printing was observed with eyes with respect to toner melt-sticking onto the photosensitive drum, and the effect thereof on the solid black images formed in the final stage was also evaluated. The evaluation was performed according to the following standard.

A: No toner melt-sticking observed on the photosensitive drum.

B: Slight toner melt-sticking is observed, but the images are not affected thereby.

C: White spotty dropouts are observed in the solid black images.

D: White spotty dropouts and shooting star-like dropouts are observed in the solid black images.

(4) Fixing Performance ($T_{F1}$ and $T_{offset}$)

The hot pressure fixation device of the above-mentioned laser beam printer was remodeled so as to allow a heating roller surface temperature setting in a range of 120° C.–250° C. Image formation was formed while changing the roller surface temperature in the range by an increment of 5° C. each in the normal temperature/normal humidity environment.

(Low Temperature Fixability-$T_{FI}$ (° C.)

Printing was performed on plain paper of 90 g/m$^2$ giving a hard fixing condition. The resultant printed image was rubbed with soft tissue paper (lens cleaning paper) under a load of 50 g/cm$^2$. A minimum temperature giving an image density lowering of 10% or less due to rubbing compared with that before rubbing was recorded as a fixing initiation temperature ($T_{FI}$ (° C.)).

(Anti-high Temperature Offset Property—$T_{offset}$ (° C.))

A sample image having an areal image percentage of ca. 5% was printed out on plain paper of 60 g/m$^2$ liable to cause offset and fixed at various temperatures so as to observe the state of soiling of the printed images. A maximum temperature at which the images were free from soiling due to offset was determined as a high-temperature offset-free temperature ($T_{offset}$ (° C.)).

The results of the evaluation with respect to the above items are shown in Table 5 together with those for the following Examples and Comparative Examples.

EXAMPLES 2–16

Comparative Examples 1–4

Toners 2–16 and Comparative Toners 1–4 were prepared in the same manner as in Example 1 except for changing the toner prescriptions (species of Binder resin), Magnetic materials and charge control agents (Azo iron compounds)) as shown in Table 4.

In Table 4, (L6) as Binder resin for Comparative Examples 3 and 4 represents Polymer (L6), and Azo compound (8) for Comparative Example 1 is Azo chromium compound (8) prepared in Production Example 8 and other Azo compounds are all azo iron compounds of which Azo iron compound (10) is amorphous and the other azo iron compounds are crystalline.

Toners 2–16 and Comparative Toners 1–4 thus prepared were evaluated in the same manner as in Example 1, and the results are shown in Table 5.

Comparative Example 5

Comparative Toner 5 was prepared in the same manner as in Example 1 except for using Chromium complex compound (11) of a formula shown below as a comparative charge control agent instead of Azo iron compound (1) and was evaluated in the same manner as in Example 1. The results of the evaluation are also shown in Table 5.

(11)

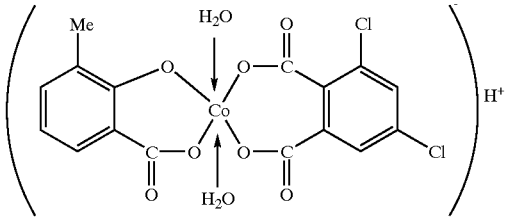

TABLE 4

| Toner Prescription and Properties | | | | | | | | |
|---|---|---|---|---|---|---|---|---|
| | | Toner prescription | | | | GPC peak molecular weight ($\times 10^3$) | | |
| Example | Toner | Binder resin | Magnetic material | Azo (Fe) compound | D4 ($\mu$m) | Lower MW peak | Higher MW peak | Acid value (mgKOH/g) |
| 1 | 1 | 1 | a | 1 | 6.8 | 14.8 | 666 | 22.7 |
| 2 | 2 | 1 | a | 2 | 6.8 | 14.9 | 675 | 22.9 |
| 3 | 3 | 1 | a | 3 | 6.9 | 14.8 | 680 | 23 |
| 4 | 4 | 1 | a | 4 | 6.8 | 14.8 | 682 | 22.4 |
| 5 | 5 | 1 | a | 5 | 6.7 | 14.9 | 672 | 22.5 |
| 6 | 6 | 1 | a | 6 | 6.9 | 14.7 | 663 | 22.6 |
| 7 | 7 | 1 | a | 7 | 6.8 | 14.8 | 676 | 23.1 |
| 8 | 8 | 2 | a | 1 | 6.9 | 9.8 | 445 | 2.4 |
| 9 | 9 | 3 | a | 1 | 6.7 | 21.8 | 980 | 20.5 |
| 10 | 10 | 4 | a | 1 | 7.0 | 6.9 | 451 | 5.1 |
| 11 | 11 | 5 | a | 1 | 6.8 | 13.7 | 433 | 70.3 |
| 12 | 12 | 6 | a | 7 | 6.8 | 14.8 | 668 | 0.1 |
| 13 | 13 | 7 | a | 7 | 6.9 | 9.9 | 142 | 21.4 |
| 14 | 14 | 1 | b | 7 | 6.9 | 14.8 | 674 | 22.8 |
| 15 | 15 | 1 | c | 7 | 6.8 | 14.9 | 685 | 22.9 |
| 16 | 16 | 1 | a | 10 | 6.9 | 14.8 | 674 | 22.8 |
| Comp. 1 | Comp. 1 | 1 | a | 8 | 6.8 | 14.9 | 670 | 22.9 |
| Comp. 2 | Comp. 2 | 1 | a | 9 | 7.0 | 14.8 | 661 | 22.6 |
| Comp. 3 | Comp. 3 | (L6) | a | 7 | 6.9 | 68 | — | 24.7 |
| Comp. 4 | Comp. 4 | (L6) | a | 9 | 6.8 | 69 | — | 24.6 |
| Comp. 5 | Comp. 5 | 1 | a | 11* | 6.9 | 14.8 | 668 | 22.8 |

*Compound (11) used in Comparative Example 5 was a Cr complex compound.

TABLE 5

| | Fixation | | Image density | | | | | |
|---|---|---|---|---|---|---|---|---|
| | | | 32.5° C./ 80% RH | | 15° C./ 10% RH | | | |
| Example | TFI (° C.) | T offset (° C.) | initial | final | initial | final | Fog 15° C./10% RH | Toner sticking 32.5° C/80% RH |
| 1 | 140 | 230 | 1.40 | 1.37 | 1.42 | 1.39 | 0.6 | A |
| 2 | 140 | 230 | 1.39 | 1.36 | 1.40 | 1.37 | 0.7 | A |
| 3 | 140 | 230 | 1.38 | 1.35 | 1.41 | 1.38 | 0.7 | A |
| 4 | 140 | 230 | 1.35 | 1.31 | 1.36 | 1.33 | 1.2 | A |
| 5 | 140 | 230 | 1.29 | 1.26 | 1.30 | 1.27 | 1.6 | B |
| 6 | 140 | 230 | 1.32 | 1.29 | 1.33 | 1.31 | 1.4 | B |
| 7 | 140 | 230 | 1.26 | 1.22 | 1.27 | 1.24 | 1.9 | B |
| 8 | 135 | 225 | 1.38 | 1.35 | 1.39 | 1.36 | 0.8 | B |
| 9 | 145 | 230 | 1.39 | 1.36 | 1.40 | 1.36 | 0.7 | A |
| 10 | 135 | 225 | 1.38 | 1.34 | 1.39 | 1.35 | 0.8 | B |
| 11 | 140 | 225 | 1.37 | 1.33 | 1.38 | 1.35 | 0.9 | A |
| 12 | 140 | 230 | 1.20 | 1.16 | 1.21 | 1.18 | 2.5 | B |
| 13 | 135 | 220 | 1.25 | 1.22 | 1.27 | 1.23 | 2.0 | B |
| 14 | 140 | 230 | 1.24 | 1.21 | 1.26 | 1.23 | 2.1 | B |
| 15 | 140 | 230 | 1.21 | 1.17 | 1.22 | 1.19 | 2.3 | B |
| 16 | 140 | 230 | 1.18 | 1.14 | 1.19 | 1.16 | 2.7 | C |
| Comp. 1 | 140 | 230 | 1.12 | 1.06 | 1.13 | 1.08 | 3.3 | C |
| Comp. 2 | 140 | 230 | 1.10 | 1.05 | 1.12 | 1.06 | 3.4 | C |
| Comp. 3 | 160 | 210 | 1.15 | 1.10 | 1.17 | 1.12 | 3.1 | C |
| Comp. 4 | 160 | 210 | 1.05 | 0.98 | 1.06 | 1.00 | 3.8 | D |
| Comp. 5 | 140 | 230 | 1.07 | 1.00 | 1.08 | 1.02 | 3.6 | D |

What is claimed is:

1. A toner comprising toner particles each comprising a binder resin, a colorant and an organometallic compound, wherein the organometallic compound is an azo iron compound formed from a monoazo compound having at least one alkyl group and two hydroxyl groups capable of bonding with an iron atom, and the toner has a tetrahydrofuran-soluble content providing a gel-permeation chromatogram showing at least one peak in a molecular weight region of $3\times10^3$ to $5\times10^4$ and at least one peak or shoulder in a molecular weight region of above $5\times10^4$ and at most $1\times10^7$, wherein the monoazo compound is represented by any one of formulae (a)–(c) shown below:

(a)

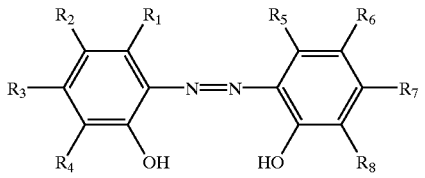

wherein $R_1$–$R_8$ independently denote a hydrogen atom, a halogen atom or an alkyl group with the proviso that at least one of $R_1$–$R_8$ is an alkyl group;

(b)

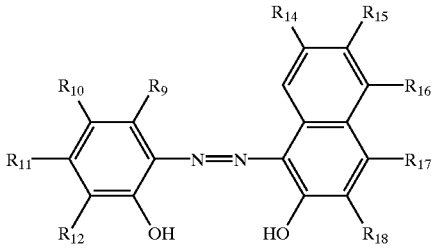

wherein $R_9$–$R_{18}$ independently denote a hydrogen atom, a halogen atom or an alkyl group with the proviso that at least one of $R_9$–$R_{18}$ is an alkyl group; and (c)

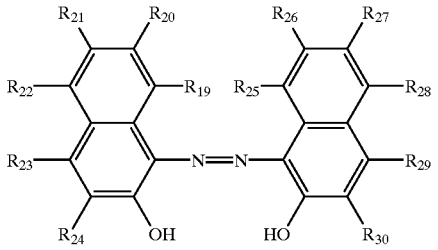

wherein $R_{19}$–$R_{30}$ independently denote a hydrogen atom, a halogen atom or an alkyl group with the proviso that at least one of $R_{19}$–$R_{30}$ is an alkyl group.

2. The toner according to claim 1, wherein the azo iron compound is a crystalline compound.

3. The toner according to claim 1, wherein the monoazo compound has at least one alkyl group having 4–12 carbon atoms.

4. The toner according to claim 1, wherein the monoazo compound has at least one alkyl group having 4–12 carbon atoms including a tertiary carbon atom.

5. The toner according to claim 1, wherein the monoazo compound has at least one alkyl group having 6–10 carbon atoms including a tertiary carbon atom.

6. The toner according to claim 1, wherein the monoazo compound is a compound represented by the formula (b) in which at least one of the groups $R_{13}$–$R_{18}$ is an alkyl group.

7. The toner according to claim 1, wherein the monoazo compound is a compound represented by the formula (b) in which at least one of the groups $R_{13}$–$R_{18}$ is an alkyl group having 4–12 carbon atoms including a tertiary carbon atom.

8. The toner according to claim 1, wherein the monoazo compound is a compound represented by the formula (b) in which at least one of the groups $R_{13}$–$R_{18}$ is an alkyl group having 6–10 carbon atoms including a tertiary carbon atom.

9. The toner according to claim 1, wherein the azo iron compound is a compound represented by any one of formulae (d)–(f) shown below:

(d)

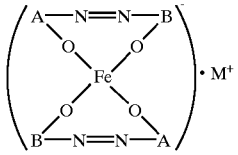

(e)

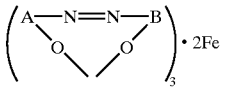

(f)

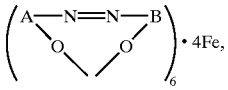

wherein A and B in each of the above formulae (d), (e) and (f), independently denote o-phenylene group or 1,2-naphthylene group with the proviso that at least one of A and B has at least one alkyl group and A and B each can further have a halogen substituent; and M denotes a cation selected from the group consisting of hydrogen ion, alkali metal ion, ammonium ion and organic ammonium ion.

10. The toner according to claim 1, wherein the azo iron compound is contained in 0.1–10 wt. parts per 100 wt. parts of the binder resin.

11. The toner according to claim 1, wherein the azo iron compound is contained in 0.5–5 wt. parts per 100 wt. parts of the binder resin.

12. The toner according to claim 1, wherein the toner has a tetrahydrofuran-soluble content providing a gel-permeation chromatogram showing at least one peak in a molecular weight region of $3\times10^3$ to $5\times10^4$ and at least one peak or shoulder in a molecular weight region of $1\times10^5$ to $1\times10^7$.

13. The toner according to claim 1, wherein the toner has a tetrahydrofuran-soluble content providing a gel-permeation chromatogram showing at least one peak in a molecular weight region of $3\times10^3$ to $3\times10^4$ and at least one peak or shoulder in a molecular weight region of $1\times10^5$ to $5\times10^6$.

14. The toner according to claim 1, wherein the toner has an acid value of 0.5–100 mgKOH/g.

15. The toner according to claim 1, wherein the toner has an acid value of 1.0–40 mgKOH/g.

16. The toner according to claim 1, wherein the colorant is a magnetic iron oxide and is contained in 20–200 wt. parts per 100 wt. parts of the binder resin.

17. The toner according to claim 16, wherein the magnetic iron oxide contains a non-iron element in a proportion of 0.05–10 wt. % based on the magnetic iron oxide.

18. The toner according to claim 17, wherein the non-iron element is an element selected from the group consisting of magnesium, aluminum, silicon, phosphorus and sulfur.

19. The toner according to claim 1, wherein the toner has a weight-average particle size of 2.5–10 $\mu$m.

20. The toner according to claim 1, wherein the toner has a weight-average particle size of 2.5–6.0 $\mu$m.

* * * * *